US005289209A

United States Patent [19]

Suzuki et al.

[11] Patent Number: 5,289,209

[45] Date of Patent: Feb. 22, 1994

[54] PRINTING HEAD FOR INK-JET PRINTER

[75] Inventors: Naomichi Suzuki, Kodaira; Toyoji Asahina, Hoya; Shizuo Yamaguchi, Sayama; Hiroshi Ogawa, Tokorozawa; Hisato Hiraishi, Tokyo; Yoshihiko Yanagawa, Musashimurayama; Nagao Mizutani, Hachioji, all of Japan

[73] Assignee: Citizen Watch Co., Ltd., Tokyo, Japan

[21] Appl. No.: 791,280

[22] Filed: Nov. 13, 1991

[30] Foreign Application Priority Data

| | | | |
|---|---|---|---|
| Nov. 13, 1990 | [JP] | Japan | 2-303935 |
| Dec. 26, 1990 | [JP] | Japan | 2-413955 |
| Dec. 27, 1990 | [JP] | Japan | 2-415002 |
| Mar. 8, 1991 | [JP] | Japan | 3-020317 |
| Mar. 8, 1991 | [JP] | Japan | 3-067559 |
| Apr. 26, 1991 | [JP] | Japan | 3-122904 |
| May 17, 1991 | [JP] | Japan | 3-140633 |

[51] Int. Cl.[5] ..... B41J 2/045; B41J 2/15

[52] U.S. Cl. ..... 346/140 R

[58] Field of Search ..... 346/140 R; B41J 2/045

[56] References Cited

U.S. PATENT DOCUMENTS

| | | | |
|---|---|---|---|
| 4,387,383 | 6/1983 | Sayko | 346/140 R |
| 4,392,145 | 6/1983 | Parkola | 346/140 R |
| 4,578,686 | 3/1986 | Vollert | 346/140 |
| 4,605,939 | 8/1986 | Hubbard et al. | 346/140 |
| 4,752,789 | 6/1988 | Maltsev | 346/140 R |

FOREIGN PATENT DOCUMENTS

| | | | |
|---|---|---|---|
| 0431692 | 6/1991 | European Pat. Off. . | |
| 53-12138 | 7/1978 | Japan . | |
| 55-17575 | 4/1980 | Japan . | |
| 57-20904 | 2/1982 | Japan . | |
| 0031758 | 2/1988 | Japan | 346/140 R |
| 63-4956 | 4/1988 | Japan . | |
| 63-247051 | 8/1988 | Japan . | |
| 63-252750 | 9/1988 | Japan . | |
| 0003311 | 1/1990 | Japan . | |

OTHER PUBLICATIONS

Utsumi et al., "Designed-Space Forming Technology in Ceramics" IMC 1986 Proceedings, May 1986, pp. 36–42.

*Primary Examiner*—Benjamin R. Fuller
*Assistant Examiner*—Alrick Bobb
*Attorney, Agent, or Firm*—Finnegan, Henderson, Farabow, Garrett and Dunner

[57] ABSTRACT

An ink-jet printing head comprises a laminated unit integrally formed as a sintered ceramic product and including a bottom insulating plate element, a top insulating plate element, and a piezoelectric plate element between the bottom and top insulating plate element, the laminated unit having a pressure chamber formed at the piezoelectric plate element fillable with an ink, the piezoelectric plate element having electrode layers formed on opposite surfaces thereof surrounding the pressure chamber, the laminated unit also being provided with an orifice in communication with the pressure chamber. The piezoelectric plate element is constituted such that its thickness is reduced upon applying a drive pulse voltage thereto, resulting in a decrease of the pressure chamber volume, whereby an ink-jet drop is ejected from the orifice.

55 Claims, 21 Drawing Sheets

PRINTING HEAD FOR INK-JET PRINTER

BACKGROUND OF THE INVENTION

1) Field of the Invention

The present invention relates to a printing head for an ink-jet printer, and more particularly, to a drop-on-demand type ink-jet printing head.

2) Description of the Related Art

As is well known, an ink-jet printer is a typical non-impact printer having a simple construction and suitable for chromatic color printing. Generally, an ink-jet printing head for the ink-jet printer includes a head body having a plurality of pressure chambers formed therein, and a plurality of orifices communicating with the respective pressure chambers, a plurality of piezoelectric actuators arranged in the head body to thus partially define the pressure chambers. respectively, and an ink source for supplying an ink to the pressure chambers, which are filled with the ink. When each of the piezoelectric actuators is selectively energized on the basis of image data obtained from a word processor, a personal computer, or the like, a volume of the corresponding pressure chamber is instantly changed and thus an ink-jet drop is ejected from the orifice thereof, and accordingly, an image is recorded on a sheet of paper by the ejected ink-jet drops.

Two drive modes for the ink-jet printing head are known in this field; a Kaiser drive mode and a shearing drive mode.

In the Kaiser drive mode as disclosed in, for example, Examined Japanese Patent Publications No. 53(1978)-12138 and No. 57(1982)-20904, the piezoelectric actuator, which is constructed as a plate-like bimorph type actuator, is arranged such that it defines a top wall of the pressure chamber, and when this plate-like bimorph type piezoelectric actuator is electrically energized, it is instantly bent in such a manner that a volume of the pressure chamber is reduced, and accordingly, an ink-jet drop is ejected from the orifice. The plate-like bimorph type piezoelectric actuator must have a relative large wide area, to enable a pressure to be generated in the pressure chamber that will cause the ejection of the ink-jet drop from the orifice. Accordingly, the pressure chambers must be disposed at a considerably wider pitch than a fine pitch at which the orifices are located. For this reason, in the Kaiser drive mode ink-jet printing head, a plurality of relative long passages must be formed, to connect the pressure chambers to the respective orifices, and thus, the Kaiser drive mode ink-jet printing head has a relatively large size, and has a further disadvantage in that a pressure loss occurs due to the long passages formed between the pressure chambers and the orifices.

In the shearing drive mode as disclosed in, for example, Unexamined Japanese Patent Publications No. 63(1988)-252750, and No. 63(1988)-247051, the pressure chambers are disposed side by side, and the piezoelectric actuators are arranged such that they form side walls of the pressure chambers. To generate a pressure at one of the pressure chambers, and eject an ink-jet drop from the orifice thereof, the piezoelectric actuators or side walls of the pressure chamber concerned are electrically energized, and thus instantly deformed, to thereby reduce a volume of the pressure chamber. The deformation of the side walls is carried out in such a manner that these side walls are subjected to a shearing stress. Of course, in this arrangement, the energizing of the piezoelectric actuators or side walls of the pressure chamber concerned affects a pressure of the ink held in the side pressure chambers adjacent thereto. Namely, the ink cannot be statically held in each of the pressure chambers, and thus it is difficult to constantly carry out a stable printing operation. Also, the shearing drive mode ink-jet printing head is disadvantageous in that ink-jet drops cannot be simultaneously ejected from the two adjacent orifices, because the two adjacent pressure chambers are bounded by the common piezoelectric actuator or side wall therebetween. Further, production of the shearing drive mode ink-jet printing head is costly because fine and precise cutting work is required when forming pressure chambers having a width of several tens of microns.

SUMMARY OF THE INVENTION

Therefore, an object of the present invention is to provide a novel ink-jet printing head which can be compactly and simply constructed at a low cost, and by which a stable printing can be constantly ensured.

In accordance with the present invention, there is provided an ink-jet printing head comprising: a laminated unit integrally formed as a sintered ceramic product and including a bottom insulating plate element, a top insulating plate element, and a piezoelectric plate element interposed between the bottom and top insulating plate element, the laminated unit having a pressure chamber formed at the piezoelectric plate element fillable with an ink, the piezoelectric plate element having an electrode layer formed on opposite surfaces thereof to surround the pressure chamber, the laminated unit also being provided with an orifice formed therein communication with the pressure chamber; and means for applying a drive pulse voltage to the piezoelectric plate element through the electrode layers, wherein the piezoelectric plate element is constituted such that the thickness is reduced upon the application of the drive pulse voltage to the piezoelectric plate element, resulting in the reducing of a volume of the pressure chamber, to thereby eject an ink-jet drop from the orifice.

BRIEF DESCRIPTION OF THE DRAWINGS

The other objects and advantages of the present invention will be better understood from the following description, with reference to the accompanying drawings, in which.

DESCRIPTION OF THE PREFERRED EMBODIMENTS

Figure 1:
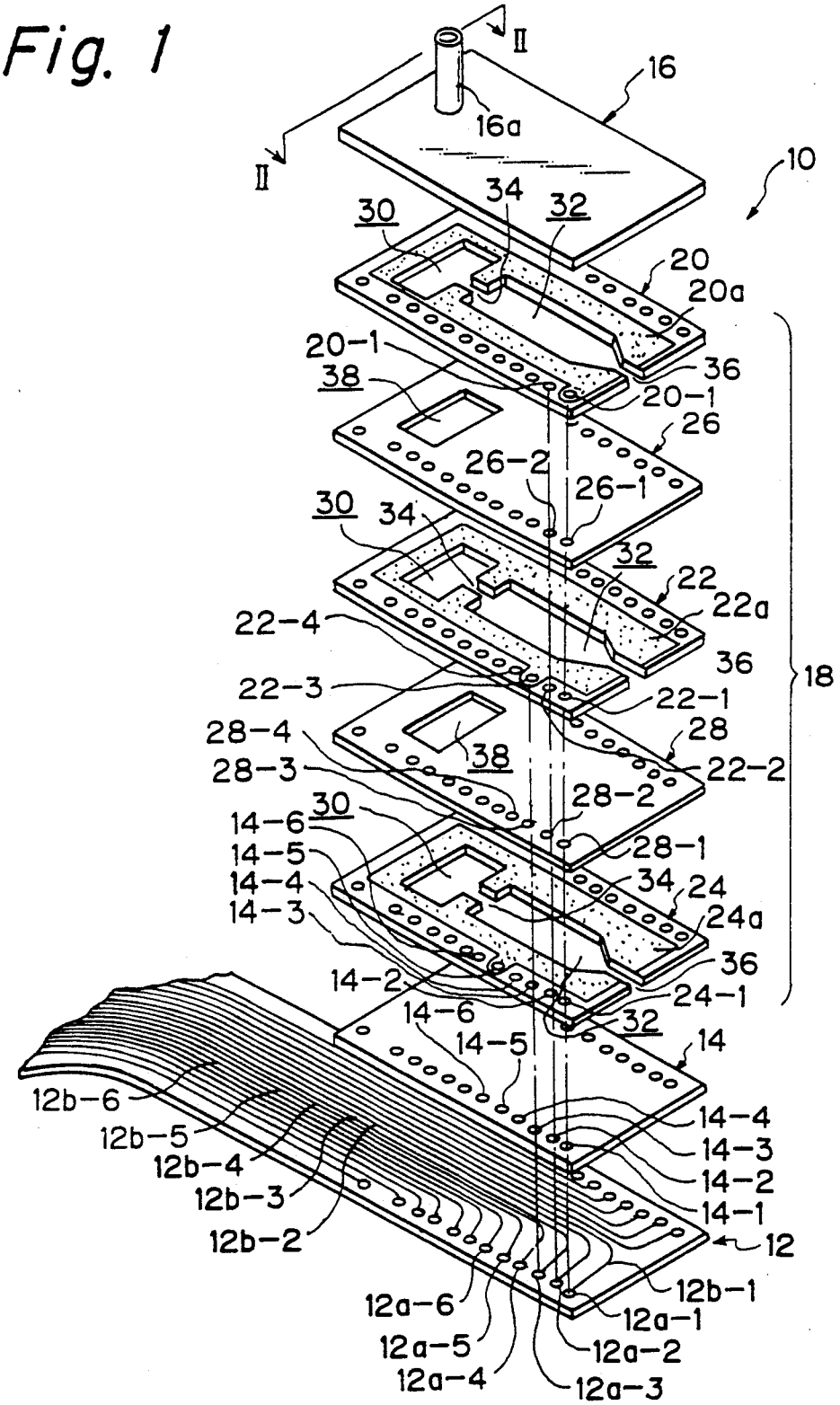
FIG. 1 is an exploded view showing a first embodiment of an ink-jet printing head according to the present invention.

FIG. 1 is an exploded view showing a first embodiment of an ink-jet printing head constructed according to the present invention, and generally indicated by reference numeral 10. This ink-jet printing head 10 is suitable for a serial ink-jet Printer, and comprises a flexible wiring sheet 12 provided with a plurality of electric terminal pads and a plurality of electric lead lines. In FIG. 1, only six of the terminal pads are indicated by reference numerals **12*a*-1, 12*a*-2, 12*a*-3, 12*a*-4, 12*a*-5, and 12*a*-6, and the six lead lines extended therefrom are indicated by reference numerals 12*b*-1, 12*b*-2, 12*b*-3, 12*b*-4, 12*b*-5. and 12*b*-6. As apparent from FIG. 1, the terminal pads are disposed along opposite sides of the flexible wiring sheet 12, at the illustrated end zone thereof, and the lead lines extend from the terminal pads, respectively. Note, a not illustrated end of the flexible wiring sheet 12** is connected to an electric source circuit (not shown).

Figure 2:
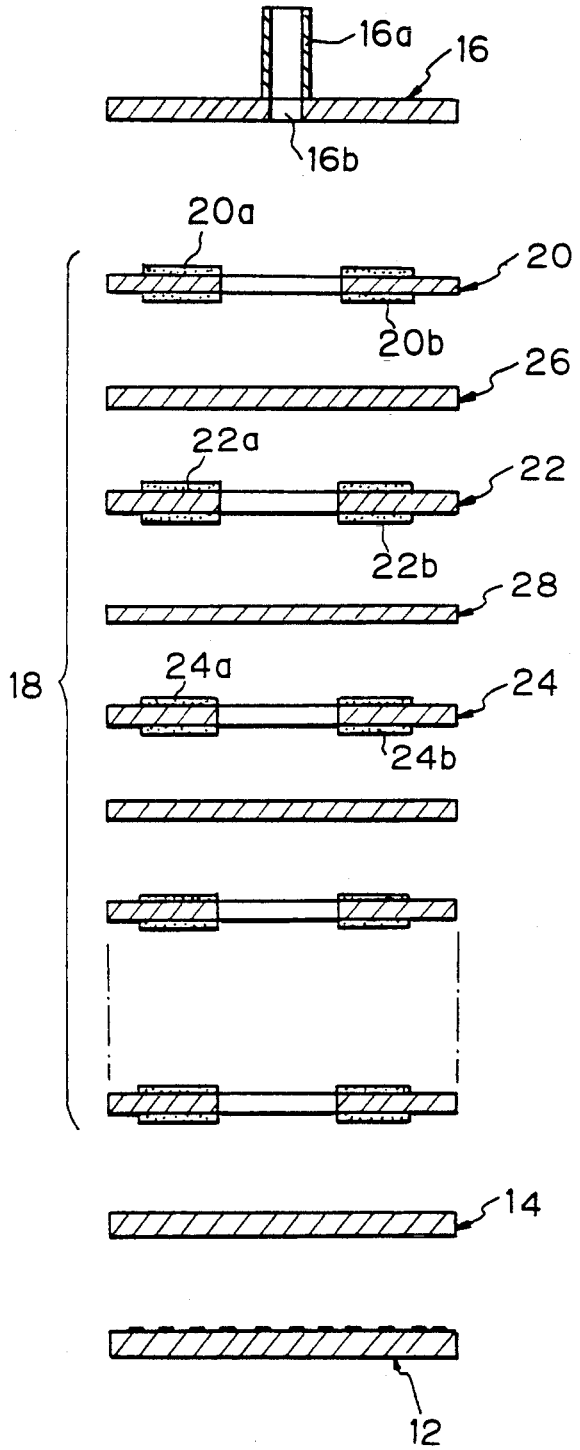
FIG. 2 is a cross sectional view taken along a line II—II of FIG. 1.

The ink-jet printing head 10 also comprises a laminated unit including a bottom insulating plate element 14, a top insulating plate element 16, and a lamination core 18 disposed therebetween. As shown in FIG. 2, the lamination core 18 includes a plurality of piezoelectric plate elements, only three of which are indicated by reference numerals 20, 22, and 24, and a plurality of intermediate insulating plate elements, only two of which are indicated by reference numerals 26 and 28. Note, in FIG. 1, only the three piezoelectric plate elements 20, 22, and 24 and only the two intermediate insulating plate elements 26 and 28 are shown, for simplicity of illustration. In the lamination core 18, the piezoelectric plate elements and the intermediate insulating plate elements are alternately laminated in such a manner that the two piezoelectric plate elements are positioned at the bottom and top of the lamination core 18. Namely, in the lamination core 18, the number of intermediate insulating plate elements is less than the number of piezoelectric plate elements by one.

The bottom insulating plate element 14 is rectangular, as shown in FIG. 1, and has a plurality of throughholes formed therein and disposed along opposite long sides thereof. In FIG. 1, only six of the throughholes of the plate element 14 are indicated by reference numerals 14-1, 14-2, 14-3, 14-4, 14-5, and 14-6. The throughholes of the plate element 14 register with the terminal pads of the flexible wiring sheet 12. The top insulating plate element 16 has the same rectangular appearance as the bottom insulating plate element 14, and is provided with an inlet pipe element **16*a* through which ink is supplied to the ink-jet printing head 10. Note, as shown in FIG. 2, the top insulating plate element 16 has an opening 16*b* formed therein and in register with the inlet pipe element 16*a***.

Each of the piezoelectric plate elements 20, 22, and 24 also has the same rectangular appearance as the bottom insulating plate element 14, and is provided with a rectangular opening 30 and an elongated opening 32 formed therein. The rectangular opening 30 communicates with the elongated opening 32 through a restricted passage 34, and the elongated opening 32 communicates with an outside an orifice 36. Also, each of the piezoelectric plate elements 20, 22, and 24 is provided with a plurality of throughholes formed therein and disposed along opposite long sides thereof. In FIG. 1, only two of the throughholes of the plate element 20 are indicated by reference numerals 20-1 and 20-2; only four of the throughholes of the plate element 22 by reference numerals 22-1, 22-2, 22-3, and 22-4; and only six of the throughholes of the plate element 24 by reference numerals 24-1, 24-2, 24-3, 24-4, 24-5, and 24-6. An arrangement of each piezoelectric plate element 20, 22, 24 also is registered with that of the terminal pads of the flexible wiring sheet 12. The other piezoelectric plate elements not shown in FIG. 1 are identical with the piezoelectric plate elements 20, 22, and 24.

The piezoelectric plate elements 20, 22, and 24 are provided with upper and lower electrode layers **20*a* and 20*b*; 22*a* and 22*b*; and 24*a* and 24*b* (FIG. 2) formed on the upper and lower surfaces thereof, respectively, to surround the rectangular opening 30, the restricted passage 34, the elongated opening 32, and the orifice 36. As shown in FIG. 1, the upper electrode layer 20*a* is partially extended to surround the throughhole 20-1. Although not visible in FIG. 1, the lower electrode layer 20*b* also is partially extended to surround the throughhole 20-2. Also, the upper electrode layer 22*a* is partially extended to surround the throughhole 22-3. Further although not visible in FIG. 1, the lower electrode layer 22*b* also is partially extended to surround the throughhole 22-4**.

Furthermore, the upper electrode layer 24*a* is partially extended to surround the throughhole 24-5. Furthermore although not visible in FIG. 1, the lower electrode layer 24*b* also is partially extended to surround the throughhole 22-4. Similarly, each of the other piezoelectric plate elements not shown in FIG. 1 is provided with upper and lower electrode layers formed on the upper and lower surfaces thereof, and each of the upper and lower electrode layers is partially extended to surround one of the throughholes.

Each of the intermediate insulating plate elements 26 and 28 also has the same rectangular appearance as the bottom insulating plate element 14, and is provided with a rectangular opening 38 formed therein. The rectangular openings 38 register with the rectangular openings 30 of the piezoelectric plate elements 20, 22, and 24. Also, each of the intermediate insulating plate elements 26 and 28 is provided with a plurality of throughholes formed therein and disposed along opposite long sides thereof. In FIG. 1, only two of the throughholes of the plate element 26 are indicated by reference numerals 26-1 and 26-2; and only four of the throughholes of the plate element 28 by reference numerals 28-1, 28-2, 28-3, and 28-4. Each intermediate insulating plate element 26 and 28 is also in registry with one of the terminal pads of the flexible wiring sheet 12. The other intermediate insulating plate elements, not shown in FIG. 1, are identical to the intermediate insulating plate elements 26 and 28.

According to the present invention, the laminated unit including the bottom insulating plate element 14, the top insulating plate element 16, and the lamination core 18 disposed therebetween, is integrally formed as a sintered ceramic product such as a PZT product, which has a potential piezoelectric effect. In particular, a shaped green sheet for the bottom insulating plate element 14, a shaped green sheet for the top insulating plate element 16, shaped green sheets for the piezoelectric plate elements (20, 22, 24), and shaped green sheets for the intermediate insulating plate elements (26, 28), are previously prepared. Note, these shaped green sheets can be precisely and inexpensively obtained from a green sheet material for, e.g. PZT products, by using punch cutting dies. On each of the shaped green sheets for the piezoelectric plate elements is spread a conductive paste, for the formation of the upper and lower electrode layers (20*a*, 20*b*; 22*a*, 22*b*; 24*a*; 24*b*), and in all of the throughholes of the shaped green sheets for the bottom insulating plate element 14, the piezoelectric plate elements (20, 22, 24), and the intermediate insulating plate elements (26, 28), the inner wall surfaces thereof are coated with a conductive paste. All of the shaped green sheets are laminated and assembled in sequence (FIG. 2), so that the throughholes of the shaped green sheets for the bottom insulating plate element 14, the piezoelectric plate elements (20, 22, 24), and the intermediate insulating plate elements (26, 28) are vertically aligned with each other, respectively. This assembly is then sintered, and thus a laminated unit is obtained as a intered ceramic product.

Figure 3:
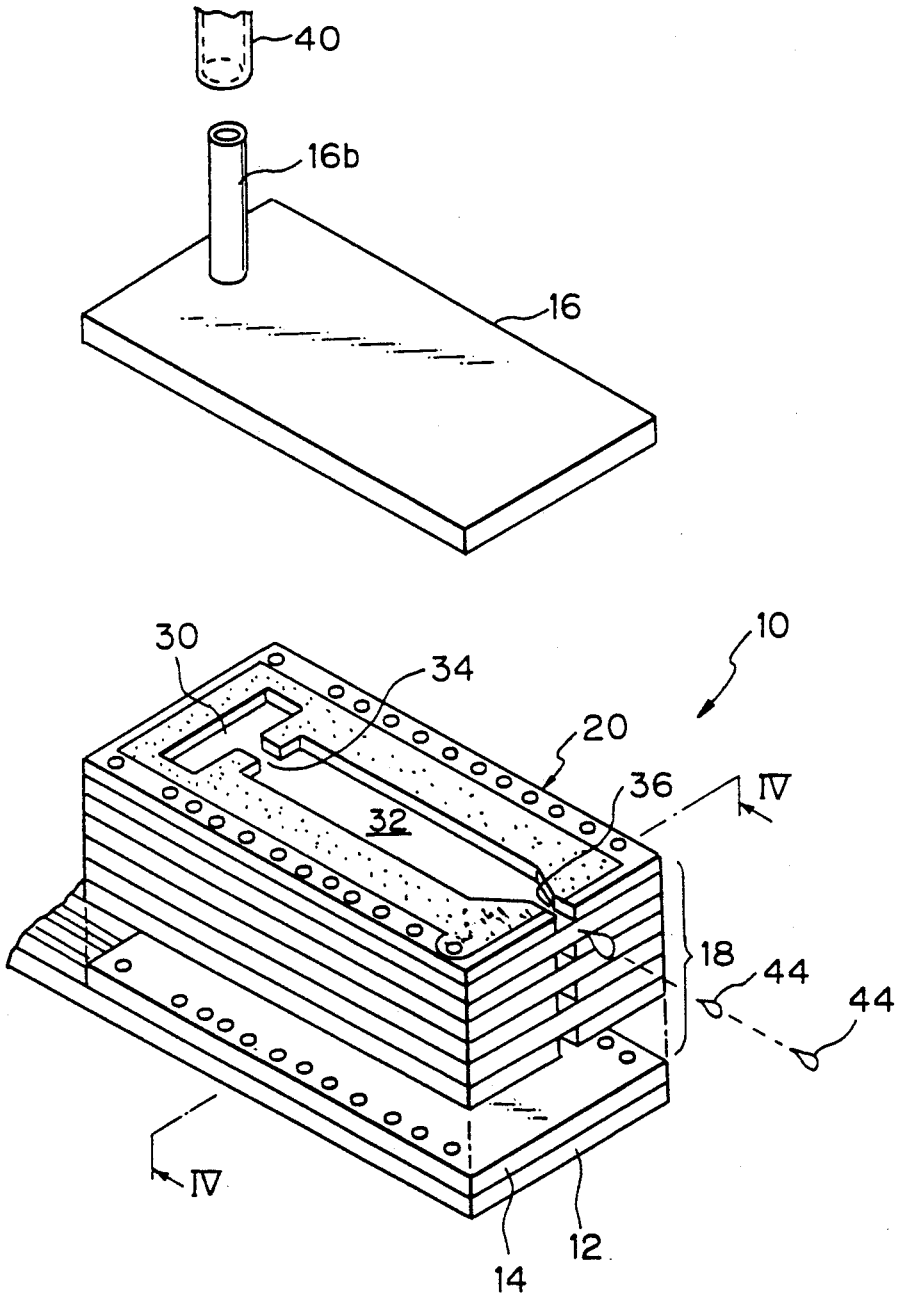
FIG. 3 is a perspective view showing the ink-jet printing head of FIG. 1.

The ink-jet printing head 10 is finished by fixing the laminated unit to the flexible wiring sheet 12, in place, with a suitable adhesive, as shown in FIG. 3, in which the top insulating plate element 16 is shown to be separated from the head 10 for simplicity. In the finished ink-jet printing head 10, the rectangular openings 30 of the piezoelectric plate elements (20, 22, 24) and the rectangular openings 38 of the intermediary plate elements (26, 28) form an ink reservoir to which an ink is supplied through the inlet pipe element 16*a* connected to an ink source (not shown) through a flexible tube 40 (FIG. 3). Also, each of the elongated openings 32 of the piezoelectric plate elements (20, 22, 24) form a pressure chamber to be filled with ink supplied from the ink reservoir.

Figure 4:
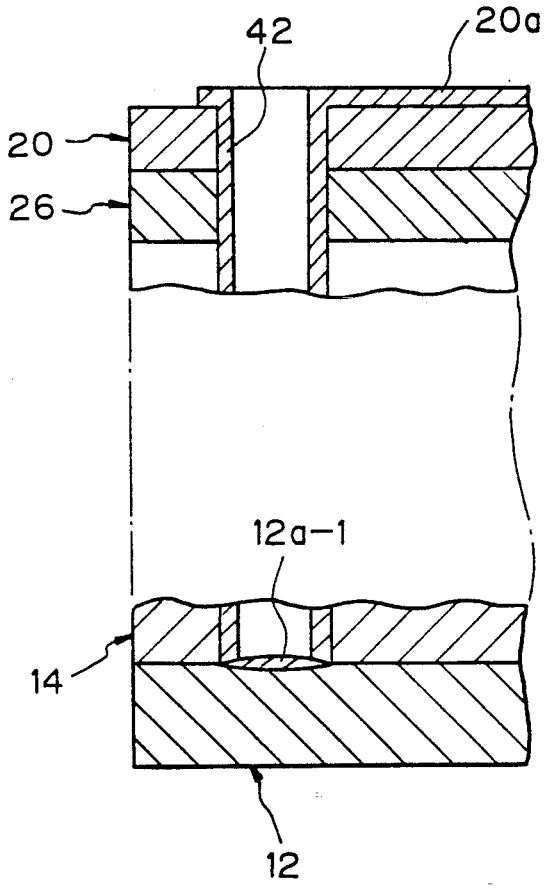
FIG. 4 is a cross sectional view taken along a line IV—IV of FIG. 3.

In the finished ink-jet printing head 10, the vertical throughholes of the bottom insulating plate element 14, of the piezoelectric plate elements (20, 22, 24), and of the intermediate insulating plate elements (26, 28) define a plurality of vertical passages, respectively, extended through the lamination core 18 and the bottom insulating plate member 14, and each of the vertical passages has a conductive lining 42 formed around an inner wall surface, as representatively shown in FIG. 4. Each of these inner conductive linings (42) is electrically connected to the corresponding electrode layer and the corresponding terminal pad of the flexible wiring sheet 12. For example, the inner conductive linings (42) formed in the vertical passages (20-1, 26-1, 22-1, 28-1, 24-1, 14-1; 20-2, 26-2, 22-2, 28-2, 24-2, 14-2; 20-3, 26-3, 22-3, 28-3, 24-3, 14-3; 20-4, 26-4, 22-4, 28-4, 24-4, 14-4; 20-5, 26-5, 22-5, 28-5, 25-5, 14-5 and 26-6, 22-6, 28-6, 24-6, 14-6) are electrically connected to the electrode layers 20*a*, 20*b*, 22*a*, 22*b*, 24*a*, and 21*b*, and the terminal pads 12*a*-1, 12*a*-2, 12*a*-3, 12*a*-1, 12*a*-5, and 12*a*-6, respectively.

In the finished ink-jet printing head 10, it is still impossible to produce a piezoelectric effect from the piezoelectric plate elements (20, 22, 24) until they are electrically polarized by applying a predetermined voltage thereto. Namely, the polarization or poling of the piezoelectric plate elements must be carried out before the piezoelectric effect can be produced therefrom. For example, when the piezoelectric plate elements are formed as a PZT product, a voltage of about 3000 v/mm is applied to each of the piezoelectric plate elements through the upper and lower electrode layers thereof. In the arrangement of this first embodiment, the poling must be independently and individually performed for the piezoelectric plate elements (20, 22, 24) because, if the poling voltage is simultaneously applied to all of the piezoelectric plate elements (20, 22, 24), the intermediate insulating plate elements (26, 28) would be polarized because an electric field is generated between the two electrode layers on each side of the intermediate insulating plate. Note, if the intermediate plate elements (26, 28) is a ceramic product having no potential piezoelectric effect, it is possible to simultaneously carry out the poling of the piezoelectric plate elements (20, 22, 24).

In the embodiment shown in FIGS. 1 to 4, preferably a thickness of the piezoelectric plate elements (20, 22, 24) is substantially equal to that of the intermediate plate elements (26, 28), and this thickness may be from about 60 to about 140 μm, if necessary. Also, a width of the orifice 36 may be from about 20 to about 50 μm, if necessary.

In operation, when a drive pulse voltage of about 30 to about 40 V is applied to, for example, the piezoelectric plate element 20, through the upper and lower electrode layers 20*a* and 20*b*, a thickness of the piezoelectric plate element 20 is instantly reduced, and accordingly, a volume of the pressure chamber 32 is changed, whereby an ink-jet drop 44 is ejected from the orifice 36 as shown in FIG. 3.

As apparent from the above, the ink-jet printing head according to the present invention can be produced at a low cost, because the shaped green sheets can be precisely and inexpensively obtained from the green sheet material by using punch cutting dies. Also, since the ink-jet drop can be directly ejected from the pressure chamber through the orifice, the ink-jet printing head according to the present invention can be compactly designed. Furthermore, since the pressure can be generated at each of the piezoelectric elements without affecting a pressure of the ink held in the pressure chamber adjacent thereto, it is possible to constantly ensure a stable printing.

Figure 5:
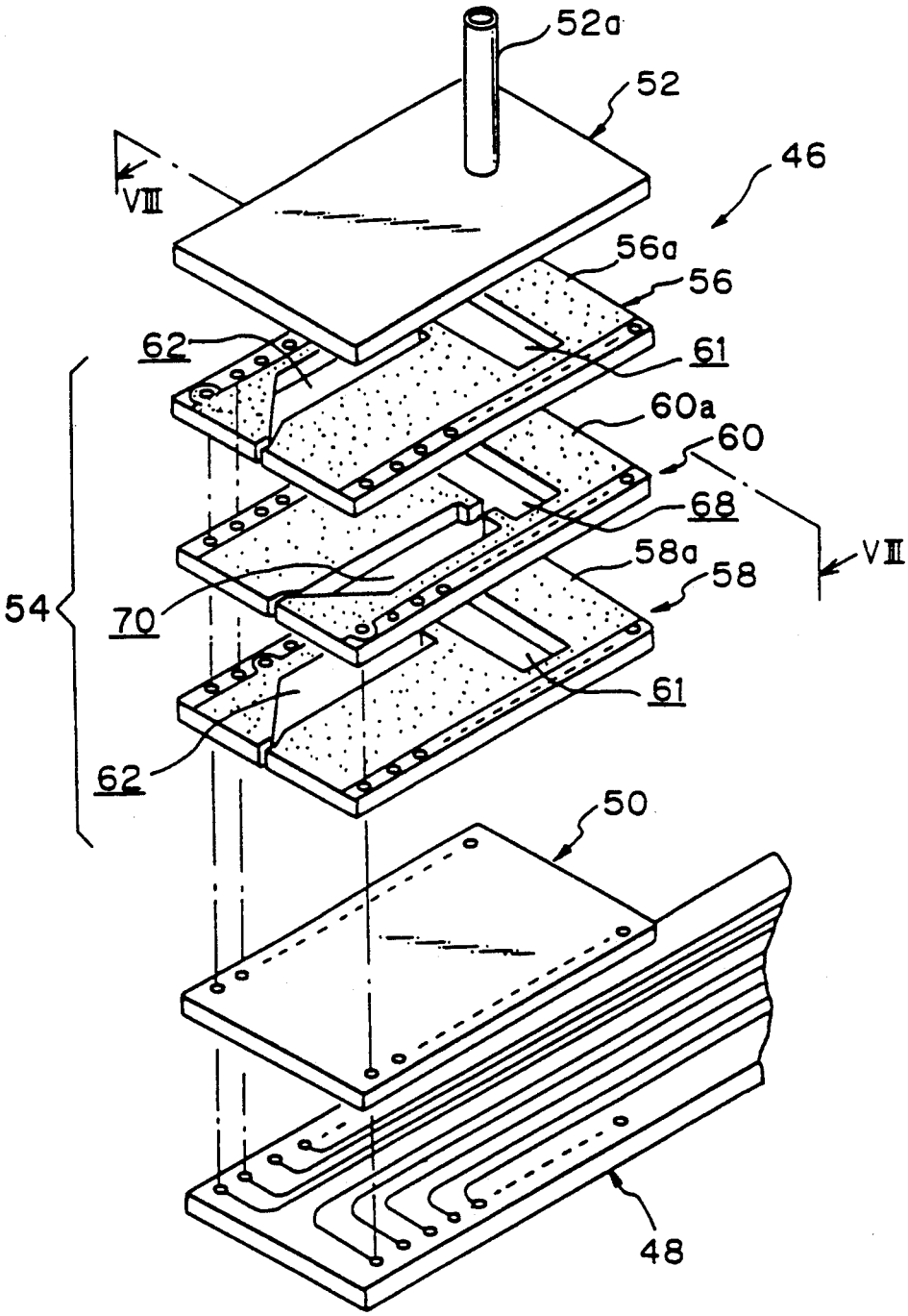
FIG. 5 is an exploded view showing a second embodiment of an ink-jet printing head according to the present invention.

FIGS. 5 to 8 show a second embodiment of an ink-jet printing head according to the present invention. This ink-jet printing head, generally indicated by reference numeral 46, comprises a flexible wiring sheet 48 constructed in substantially the same manner as the flexible wiring sheet 12. Namely, as shown in FIG. 5, the flexible wiring sheet 48 has a plurality of electric terminal pads and a plurality of electric lead lines formed thereon. The ink-jet printing head 46 also comprises a laminated unit including a bottom insulating plate element 50, a top insulating plate element 52, and a lamination core 54 disposed therebetween. The bottom and top insulating plate elements 50 and 52 are constructed in substantially the same manner as the bottom and top insulating plate elements 14 and 16 of the first embodiment (FIG. 1). Namely, the bottom plate element 50 has a plurality of throughholes formed therein and disposed along opposed long sides thereof, and the top insulating plate element 52 has an inlet pipe element 52*a* through which an ink is supplied to the ink-jet printing head 46.

In the second embodiment of FIGS. 5 to 8, the lamination core 54 includes two kinds of piezoelectric plate elements. In FIG. 5, only two of the piezoelectric plate elements of the first kind are indicated by reference numerals 56 and 58; and only one of the piezoelectric plate elements of the second kind by reference numeral 60. Each of the two kinds of the piezoelectric plate elements (56, 58, 60) has a plurality of throughholes formed therein and disposed along opposite long sides thereof, and these throughholes register with the throughholes of the bottom plate element 50.

Figure 6:
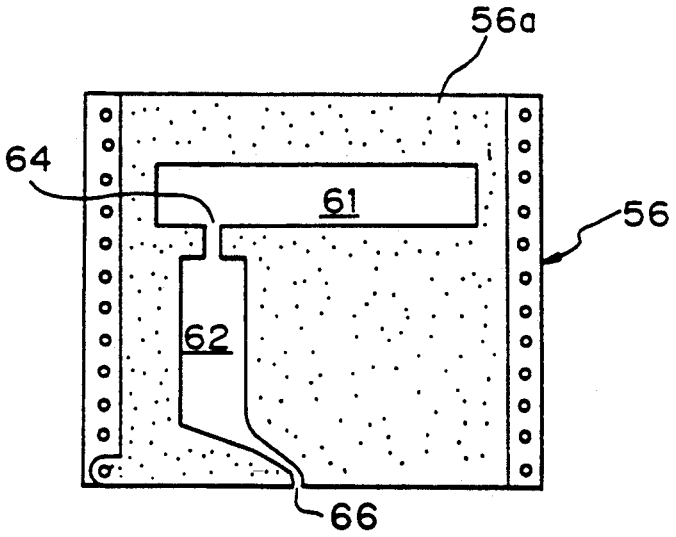
FIG. 6 is a plane view showing one type of an piezoelectric plate element used in the ink-jet printing head of FIG. 5.

As shown in FIG. 6, each of the piezoelectric plate elements 56 and 58 has a rectangular opening 61 and an elongated opening 62 formed therein. The rectangular opening 61 communicates with the elongated opening 62 through a restricted passage 64, and the elongated opening 62 communicates with an outside through the orifice 66. In this connection, the piezoelectric plate elements 56 and 58 are identical to the other piezoelectric plate elements of the first kind, not shown in FIG. 5. The piezoelectric plate element 56 is provided with upper and lower electrode layers 56*a* and 56*b* (FIG. 8) formed on the upper and lower surfaces thereof, respectively, to surround the rectangular opening 61, the restricted passage 64, the elongated opening 62, and the orifice 66. As shown in FIG. 5, the upper electrode layer 56*a* is partially extended to surround one of the throughholes of the piezoelectric plate element 56. Although not visible in FIG. 5, the lower electrode layer 56*b* also is partially extended to surround other throughholes of the piezoelectric plate element 56. Similarly, each of the other piezoelectric plate elements (58) of the first kind is provided with upper and lower electrode layers formed on the upper and lower surfaces thereof, respectively, to surround the rectangular opening, the restricted passage, the elongated opening, and the orifice. Each of these upper and lower electrode layers is partially extended to surround one of the throughholes of the piezoelectric plate element concerned.

Figure 7:
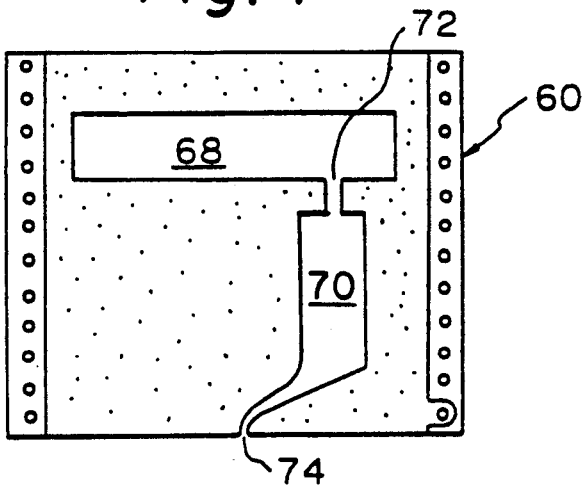
FIG. 7 is a plane view showing another type of an piezoelectric plate element used in the ink-jet printing head of FIG. 5.

Also, as shown in FIG. 7, the piezoelectric plate element 60 has a rectangular opening 68 and an elongated opening 70 formed therein. The rectangular opening 68 communicates with the elongated opening 70 through a restricted passage 72, and the elongated opening 70 communicates with an outside through an orifice 74. In this connection, the piezoelectric plate elements 60 is identical to the other piezoelectric plate elements of the second kind, not shown in FIG. 5. The piezoelectric plate element 60 is provided with upper and lower electrode layers 60*a* and 60*b* (FIG. 8) formed on the upper and lower surfaces thereof, respectively, to surround the rectangular opening 68, the restricted passage 72, the elongated opening 70, and the orifice 74. As shown in FIG. 5, the upper electrode layer 60*a* is partially extended to surround one of the throughholes of the piezoelectric plate element 60. Although not visible in FIG. 5, the lower electrode layer 60*b* also is partially extended to surround another throughholes of the piezoelectric plate element 60. Similarly, each of the other piezoelectric plate elements of the second kind is provided with upper and lower electrode layers formed on the upper and lower surfaces thereof, respectively, to surround the rectangular opening, the restricted passage, the elongated opening, and the orifice. Each of these upper and lower electrode layers is partially extended to surround one of the throughholes of the piezoelectric plate element concerned.

In the arrangement of FIG. 5, the rectangular opening 61 of the first kind of piezoelectric plate elements (56, 58) and the rectangular opening 68 of the second kind of piezoelectric plate elements (60) are in register with each other, but the elongated opening 62 of the former and the elongated opening 70 are symmetrically disposed with respect to a longitudinally central axis of the ink-jet printing head 46.

As apparent from FIG. 5, the lamination core 54 is formed by alternately laminating the piezoelectric plate elements (56, 58) of the first kind and the piezoelectric plate elements (60) of the second kind are alternately laminated with respect to each other. Although the piezoelectric plate element (56) of the first kind is disposed at the top of the lamination core 54, it may be replaced by the piezoelectric plate element (60) of the second kind.

Figure 8:
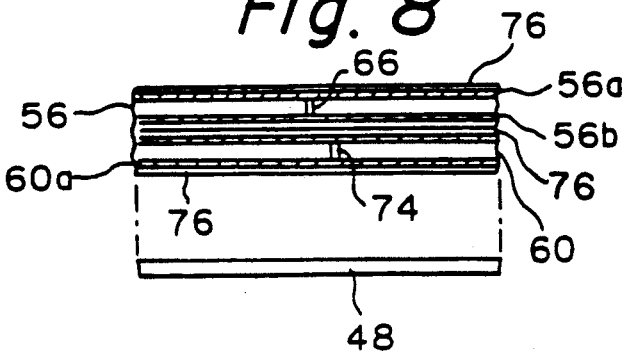
FIG. 8 is a cross sectional view taken along a line VIII—VIII of FIG. 5.

The laminated unit including the bottom insulating plate element 50, the top insulating plate element 52, and the lamination core 54 disposed therebetween, is integrally formed as a sintered ceramic product such as a PZT product, in substantially the same manner as in the first embodiment, except that each of shaped green sheets for the piezoelectric plate elements (56, 58, 60) of the two kinds is coated with an electric insulating material over the upper and lower surfaces thereof. Thus, in the laminated unit obtained as the sintered ceramic product, an electric insulating layer 76 is formed between the two adjacent laminated elements included in the laminated unit, as shown in FIG. 8.

Similar to the first embodiment, the ink-jet printing head 46 is finished by fixing the laminated unit to the flexible wiring sheet 48, in place, with a suitable adhesive. In the finished ink-jet printing head 46, an ink reservoir is formed by the rectangular openings (61) of the piezoelectric plate elements (56, 58) of the first kind and the rectangular openings (68) of the piezoelectric plate elements (60) of the second kind, and a pressure chamber is formed by each of the elongated openings (62, 70) of the piezoelectric plate elements (56, 58, 60) of the two kinds. Also, the upper and lower electrode layers of the piezoelectric plate elements (56, 58, 60) of the two kinds are electrically connected to the terminal pads of the flexible wiring sheet 48 in substantially the same manner as in the first embodiment. Furthermore, each of the piezoelectric plate elements (56, 58, 60) of the two kinds is polarized in the same manner as in the first embodiment.

The ink-jet printing head shown in FIGS. 5 to 8 is characterized in that the orifices (66, 74) can be disposed at a finer pitch than the orifice pitch of the first embodiment as mentioned above, because an electric insulating plate element (26, 28) is not intervened between the two adjacent piezoelectric plate elements in the second embodiment, and accordingly, the ink-jet printing head 46 is suitable for a high resolution printing. For example, when the piezoelectric plate elements (56, 58, 60) have a thickness of 70 μm, it is possible to carry out a printing at 360 dpi (dot per inch). Also, when the piezoelectric plate elements (56, 58, 60) have a thickness of 65 μm, it is possible to carry out a printing at 400 dpi.

Figure 9:
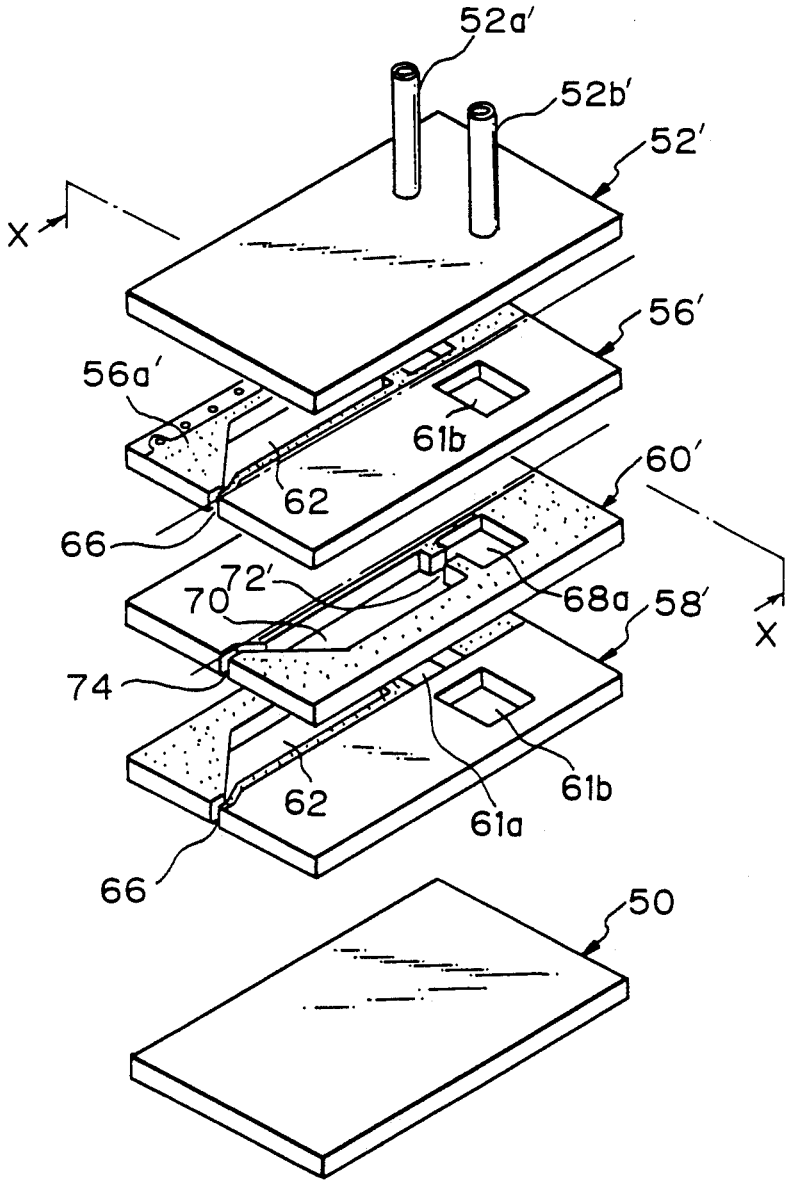
FIG. 9 is a perspective view showing a modification of the second embodiment of FIG. 5.

FIG. 9 shows a modification of the second embodiment. In this modified embodiment, each of the piezoelectric plate elements (56', 58') of the first kind has two rectangular openings 61*a* and 61*b* in the place of the single rectangular opening 61. The rectangular opening 61*a* is communicated with the elongated opening 62 through a restricted passage (not visible in FIG. 9). Similarly, each of the piezoelectric plate elements (60') of the second kind also has two rectangular openings, one not being not visible in FIG. 9. The visible rectangular opening, indicated by reference numerals 68*a*, is communicated with the elongated opening 70 through a restricted passage 72'.

In FIG. 9, a first ink reservoir is formed by the rectangular openings (61*a*) of the piezoelectric plate elements (56', 58') of the first kind and the rectangular openings (not visible) of the piezoelectric plate elements (60') of the second kind, and is supplied with an ink through an first inlet pipe element 52*a'* of a top insulating plate element 52'. A second ink reservoir is formed by the rectangular openings (61*b*) of the piezoelectric plate elements (56', 58') of the first kind and the rectangular openings (68*a*) of the o piezoelectric plate elements (60') of the second kind, and is supplied with an ink through an second inlet pipe element 52*b'* of the top insulating plate element 52'.

Also, in the modified embodiment, each of the piezoelectric plate elements (56', 58') of the first kind has an upper electrode layer (56*a'*) and a lower electrode layer (not visible) formed on the upper and lower surfaces thereof. The upper electrode layer (56*a'*) surrounds the rectangular openings 61*a*, the restricted passage (not visible in FIG. 9), the elongated opening 62, and the orifice 66, but it does not reach beyond a longitudinal center line of the piezoelectric plate element. This also is true for the lower electrode layer (not visible). Similarly, each of the piezoelectric plate elements (60') of the second kind has an upper electrode layer (60*a'*) and a lower electrode layer (not visible) formed on the upper and lower surface thereof. The upper electrode layer (60*a'*) surrounds the rectangular openings 68*a*, the restricted passage 72', the elongated opening 70, and the orifice 74, but does not reach beyond a longitudinal center line of the piezoelectric plate element. This also is true for the lower electrode layer (not visible). Thus, it is unnecessary to coat each of shaped green sheets for the piezoelectric plate elements (56', 58', 60') of the two kinds with an electric insulating material, over the upper and lower surfaces thereof.

Figure 10:
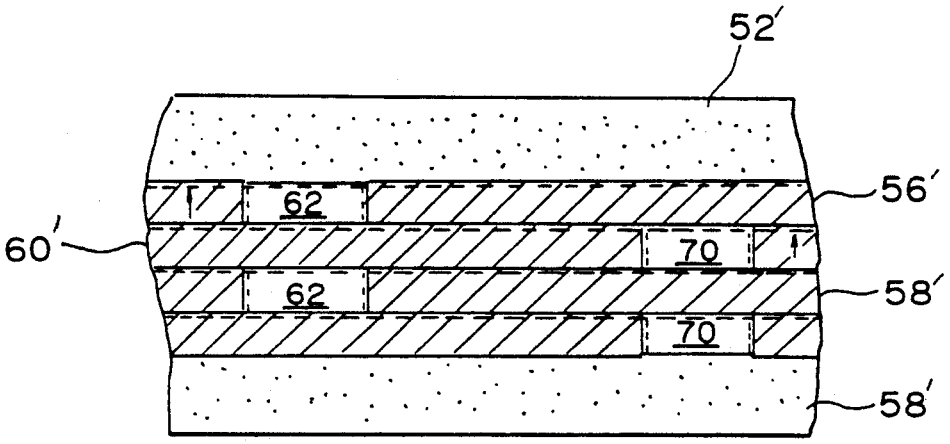
FIG. 10 is a cross sectional view taken along a line X—X of FIG. 9.

FIG. 10 is a cross sectional view of an ink-jet printing head constructed on the basis of the embodiments as shown in FIGS. 5 to 9. When each of the piezoelectric plate elements is polarized in a direction indicated by an arrow shown in FIG. 10, and when a drive pulse voltage is applied to each of the piezoelectric plate elements so that an electric field is reversely oriented with respect to the direction of poling, a thickness of the piezoelectric plate element is reduced as indicated by a broken line in FIG. 10, so that a volume of the pressure chamber 62, 70 can be reduced.

Figure 11:
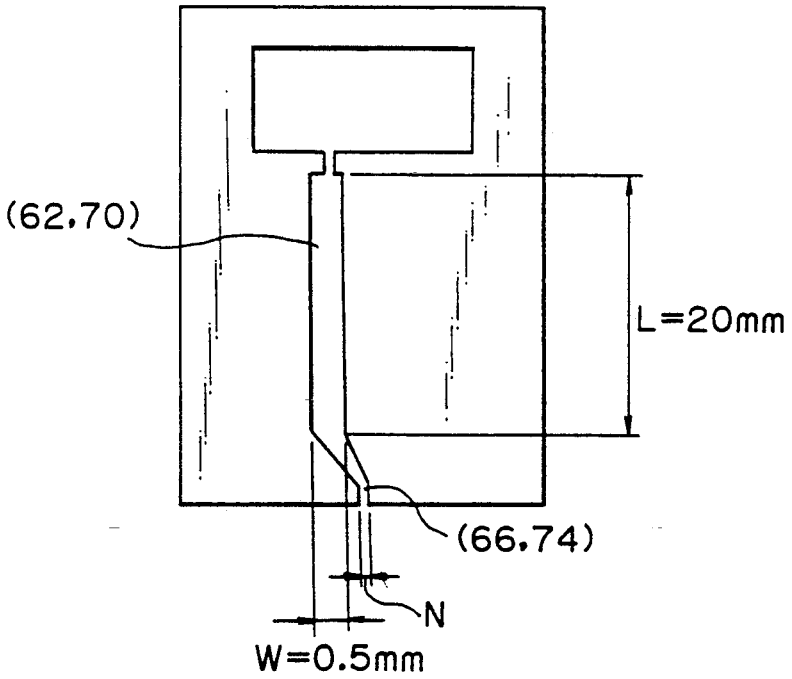
FIG. 11 is a schematic plane view showing a piezoelectric plate element used in the ink-jet printing head of FIGS. 5 and.9.

Nevertheless, a change of volume of the pressure chamber 62, 70 must be sufficient to ensure an ejection of an ink-jet drop from the orifice 66, 74. For example, when the piezoelectric plate element is PZT, and when a drive pulse voltage is 25 V, the pressure chamber 62, 70 preferably has a length L of 20 mm and a width W of 0.5 mm, as shown in FIG. 11, for the following reasons:

When the piezoelectric plate element is PZT, a piezoelectric constant $d_{33}$ thereof in a direction of thickness of the piezoelectric plate element is as shown below:

$$d_{33}=4\times10^{-10}\ m/V$$

When the drive pulse voltage of 25 V is applied to the piezoelectric plate element, a change of thickness thereof δ is as shown below:

$$\delta=0.01\ \mu m$$

Note, the value of δ is not related to a thickness of the piezoelectric plate element.

Accordingly, a change of volume δ P of the pressure chamber is as defined below:

$$\delta P=\delta\times W\times L$$

Since W=0.5 mm, and L=20 mm, $$\delta P=1\times10^{-4}\ mm^3$$

If an ink-jet drop ejected from the orifice 66, 74 has a diameter of 30 μm, a volume of the ink-jet drop Q is as shown below:

$$Q=1.4\times10^{-5}\ mm^3$$

Accordingly, a ratio of δ P to Q is 7.

This proves that the change of volume of the pressure chamber is sufficient to ensure an ejection of the ink-jet drop. Note, preferably a width N of the orifice is from about 20 to 30 μm.

Figure 12:
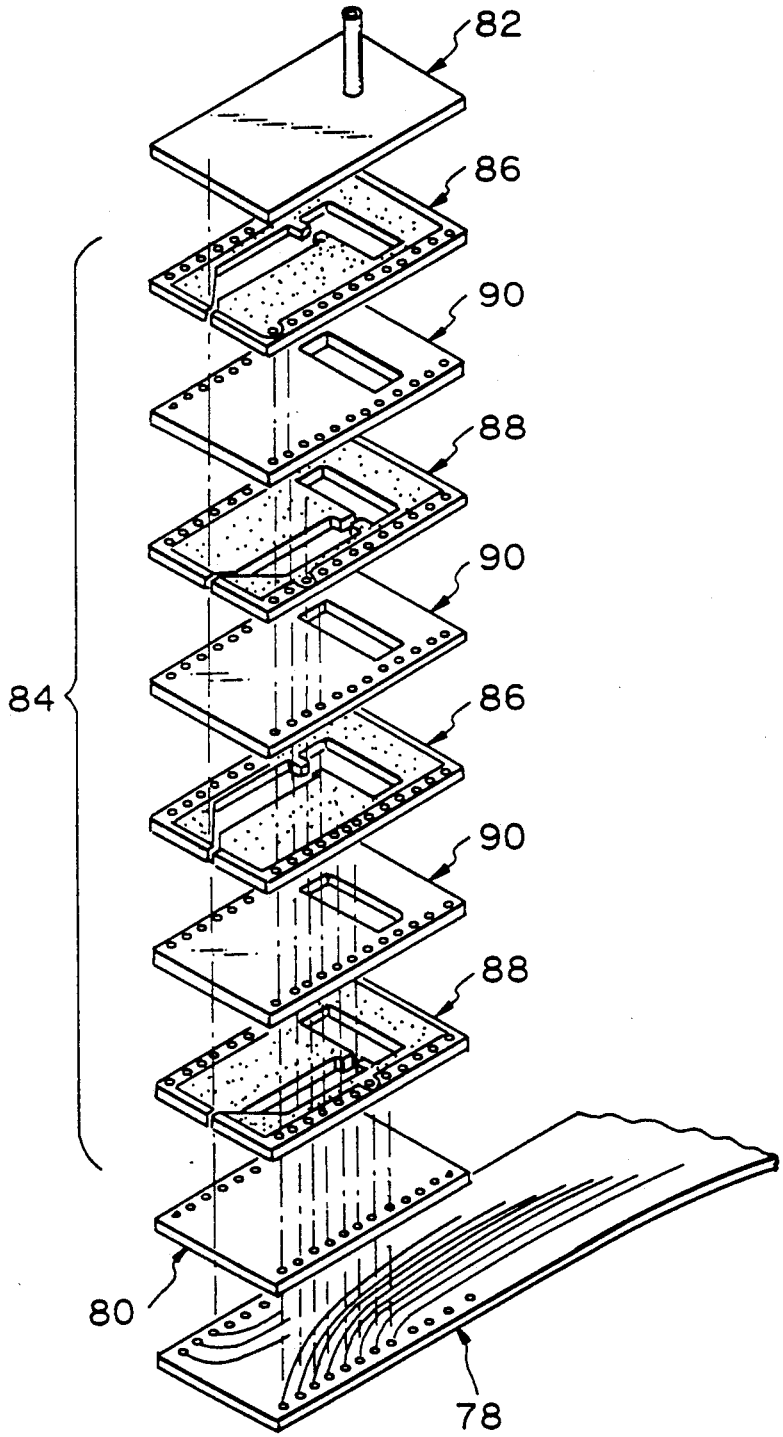
FIG. 12 is an exploded view showing a third embodiment of an ink-jet printing head according to the present invention.

FIG. 12 shows a third embodiment of an ink-jet printing head according to the present invention. This ink-jet printing head comprises: a flexible wiring sheet 78 constructed in substantially the same manner as the flexible wiring sheet 12; a laminated unit including a bottom insulating plate element 80, a top insulating plate element 82; and a lamination core 84 disposed therebetween. The bottom and top insulating plate elements 80 and 82 are constructed in substantially the same manner as the bottom and top insulating plate elements 14 and 16 of the first embodiment (FIG. 1).

In the third embodiment, the lamination core 84 includes two kinds of piezoelectric plate elements. In FIG. 12, only two of the piezoelectric plate elements of the first kind are indicated by reference numerals 86; and only two of the piezoelectric plate elements of the second kind by reference numeral 88. The piezoelectric plate elements 86 of the first kind and the piezoelectric plate elements 88 of the second kind are constructed in substantially the same manner as the two kind of piezoelectric plate elements (56, 58; 60) used in the second embodiment (FIG. 5), respectively. The two kinds of piezoelectric plate elements 86, 88 of the two kinds are disposed alternately. The lamination core 84 further includes intermediate insulating plate elements 90 constructed in substantially the same manner as the intermediary insulating plate element (26, 28) used in the first embodiment (FIG. 1). Each of the intermediate insulating plate elements 90 is interposed between the two adjacent piezoelectric plate elements (86) and (88), as shown in FIG. 12. The laminated unit including the bottom insulating plate element 80, the top insulating plate element 82, and the lamination core 84 disposed therebetween, is integrally formed as a sintered ceramic product such as a PZT product in substantially the same manner as in the first embodiment. The ink-jet printing head also is finished by fixing the laminated unit to the flexible wiring sheet 78, in place, with a suitable adhesive.

In the finished ink-jet printing head 46, the upper and lower electrode layers of the two kinds of piezoelectric plate elements (86, 88) of the two kinds are electrically connected to the terminal pads of the flexible wiring sheet 78 in substantially the same manner as in the first embodiment. Furthermore, each of the piezoelectric plate elements (56, 58, 60) of the two kinds is polarized in the same manner as in the first embodiment.

In the ink-jet printing head shown in FIG. 12, the pressure chambers are alternately offset from each other, so that a rigidity of the laminated unit is enhanced, and thus a thickness of the intermediate insulating plate element can be reduced. Accordingly, the orifices can be disposed at a finer pitch than the orifice pitch of the first embodiment as mentioned above.

FIGS. 13 to 16 show a fourth embodiment of an ink-jet printing head according to the present invention. This ink-jet printing head comprises: a flexible wiring sheet 92 constructed in substantially the same manner as the flexible wiring sheet 12; a laminated unit including a bottom insulating plate element 94, a top insulating plate element 95, and a lamination core 96 disposed therebetween. The bottom and top insulating plate elements 94 and 95 are constructed in substantially the same manner as the bottom and top insulating plate elements 14 and 16 of the first embodiment (FIG. 1).

Figure 13:
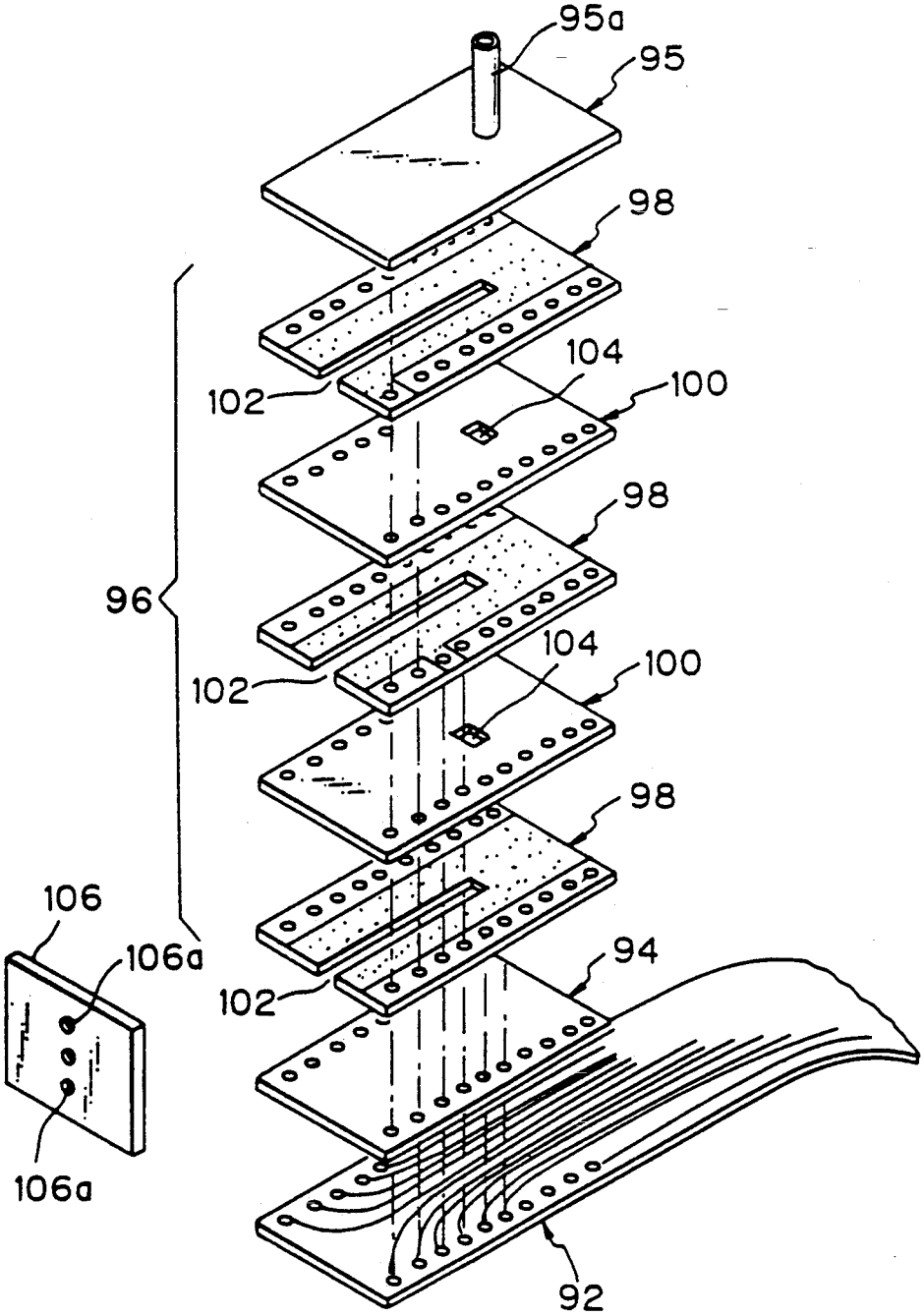
Figure 13 is an exploded view showing a fourth embodiment of an ink-jet printing head according to the present invention.

For simplicity, although the lamination core 96 is shown to include three piezoelectric plate elements 98 and two intermediate insulating plate elements 100, it may be formed by more than three piezoelectric plate elements 98 and by more than two intermediate insulating plate elements 100, as long as the number of piezoelectric plate elements is more than that of the intermediate insulating plate elements, by one. Each of the piezoelectric plate elements 98 has an elongated opening 102 formed therein and open to an outside at one end thereof. The piezoelectric plate elements 98 and the intermediate insulating plate elements 100 are alternately laminated in such a manner that the two piezoelectric plate elements are positioned at the bottom and top of the lamination core 96. Each of the piezoelectric plate elements 98 is provided with upper and lower electrode layers formed on the upper and lower surfaces thereof to surround the corresponding elongated opening 102. In FIG. 13, the upper electrode layer of each piezoelectric plate element 98 is indicated by reference numeral 98*a*; the lower electrode layer thereof is not visible. Each of the intermediate insulating plate elements 100 has a rectangular opening 104 formed therein.

The laminated unit including the bottom insulating plate element 94, the top insulating plate element 95, and the lamination core 96 disposed therebetween, is integrally formed as a sintered ceramic product, such as a PZT product, in substantially the same manner as in the first embodiment. As apparent from FIG. 13, an orifice plate element 106 having three orifices 106*a* formed therein is attached to a front end face of the laminated unit with a suitable adhesive, whereby the orifices 106*a* are aligned with the opened ends of the elongated openings 104, respectively. If the orifice plate element 106 is formed of a suitable ceramic material, it may be sintered together with the laminated unit.

Figure 14:
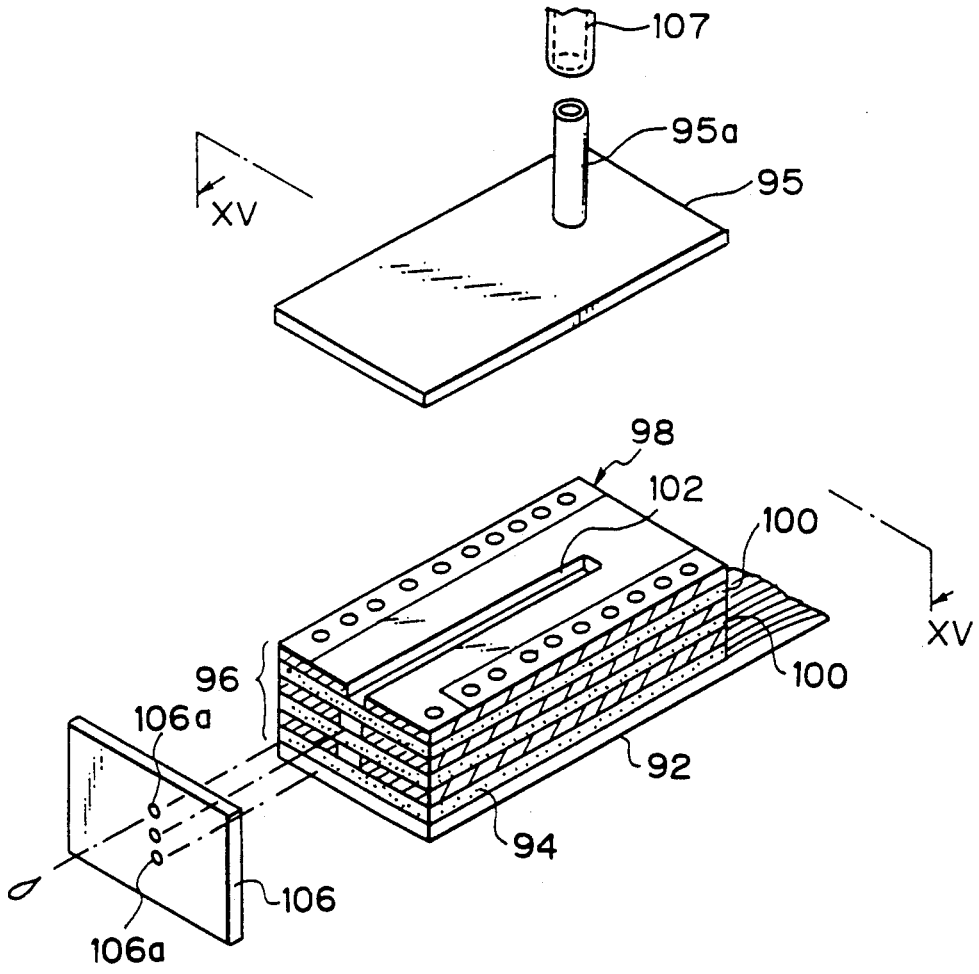
FIG. 14 is a perspective view showing the ink-jet printing head of FIG. 13.

The ink-jet printing head is finished by fixing the laminated unit to the flexible wiring sheet 12, in place, with a suitable adhesive, as shown in FIG. 14; in which the top insulating plate element 95 and the orifice plate 106 are shown to be separated from the laminated unit, for simplicity. In this ink-jet printing head, the rectangular openings 104 of the intermediate insulating plate elements 100 cooperate with the closed end zones of the elongated openings 102 to form an ink reservoir to which an ink is supplied through an inlet pipe element 95*a* of the top insulating plate element 95, which is connected to an ink source (not shown) through a flexible tube 107. Each of the elongated openings 102 of the piezoelectric plate elements 98 form a pressure chamber which is filled with the ink supplied from the ink reservoir. The upper and lower electrode layers of the piezoelectric plate elements 98 are electrically connected to terminal pads of the flexible wiring sheet 92 in substantially the same manner as in the first embodiment. Also, each of the piezoelectric plate elements 98 is polarized in the same manner as in the first embodiment.

Figure 15:
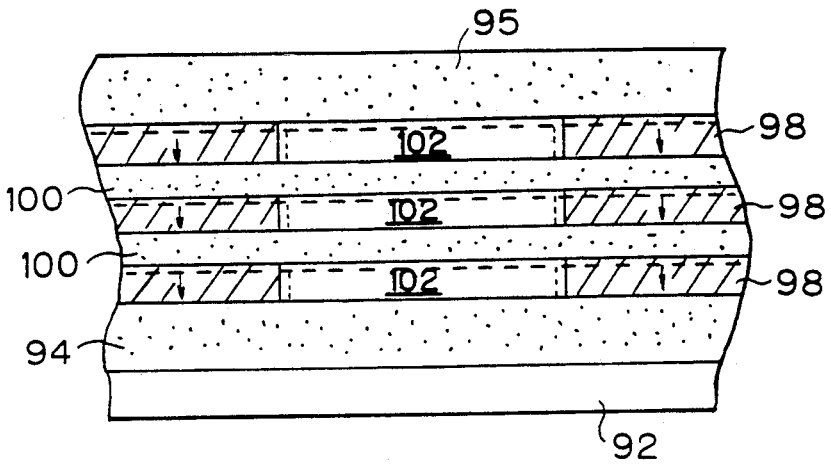
FIG. 15 is a cross sectional view taken along a line XV—XV of FIG. 14.

FIG. 15 is a cross sectional view of an ink-jet printing head shown in FIG. 13. When each of the piezoelectric plate elements 98 is polarized in a direction indicated by an arrow in FIG. 15, and when a drive pulse voltage is applied to each of the piezoelectric plate elements so that an electric field is reversely oriented with respect to the direction of poling, a thickness of the piezoelectric plate element 98 is reduced as indicated by a broken line in FIG. 15, and thus the volume of the pressure chamber 102 is reduced.

Figure 16:
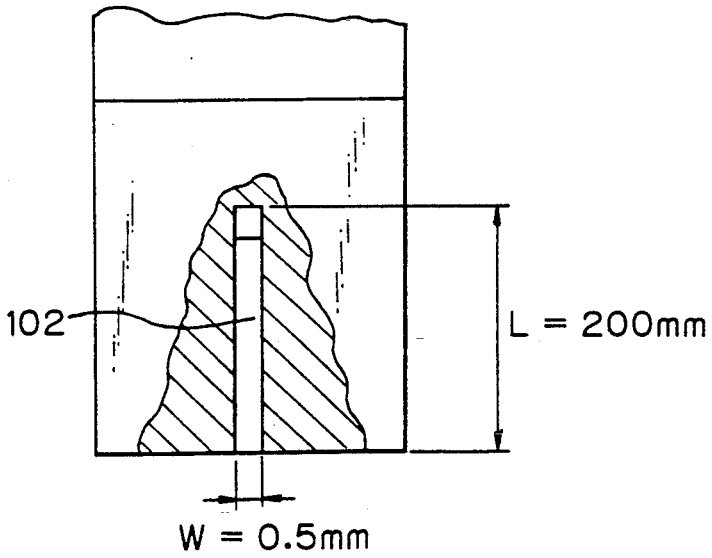
FIG. 16 is a schematic plane view showing a piezoelectric plate element used in the ink-jet printing head of FIG. 14.

For example, when the piezoelectric plate elements 98 is PZT, and when a drive pulse voltage is 25 V, the pressure chambers 102 preferably have a length L of 20 mm and a width W of 0.5 mm, as shown in FIG. 16, for the following reasons:

When the piezoelectric plate elements 98 is PZT, a piezoelectric constant $d_{33}$ thereof in the direction of thickness of the piezoelectric plate element is as shown below:

$$d_{33}=4\times10^{-10}\ m/V$$

When the drive pulse voltage of 25 V is applied to the piezoelectric plate element, a change of thickness thereof δ is as shown below:

$$\delta = 0.01\ \mu m$$

Note, the value of δ is not related to a thickness of the piezoelectric plate element.

Accordingly, a change of volume δ P of the pressure chamber is as defined below:

$$\delta P = \delta \times W \times L$$

Since W=0.5 mm, and L=20 mm, $$\delta P = 1 \times 10^{-4}\ mm^3$$

If an ink-jet drop ejected from the orifice 106*a* has a diameter of 30 μm, $$Q = 1.4 \times 10^{-5}\ mm^3$$

wherein Q is a volume of the ink-jet drop.

Accordingly, a ratio of δ P to Q is 7.

This proves that the change of volume of the pressure chamber is sufficient to ensure the ejection of the ink-jet drop. Note, preferably a diameter of the orifices 106*a* is about 30 μm.

In the first, second, and third embodiments as mentioned above, the fine orifices, which are directly formed in the laminated unit, are easily clogged during the production of the printing head, and as is obvious, if only one of the orifices becomes clogged, the printing head no longer usable. Therefore, in the fourth embodiment shown in FIG. 13, since the orifice plate element 106 with the fine orifices 106*a* is produced independently of the production of the laminated unit, a yield rate of the printing head can be increased.

Figure 17:
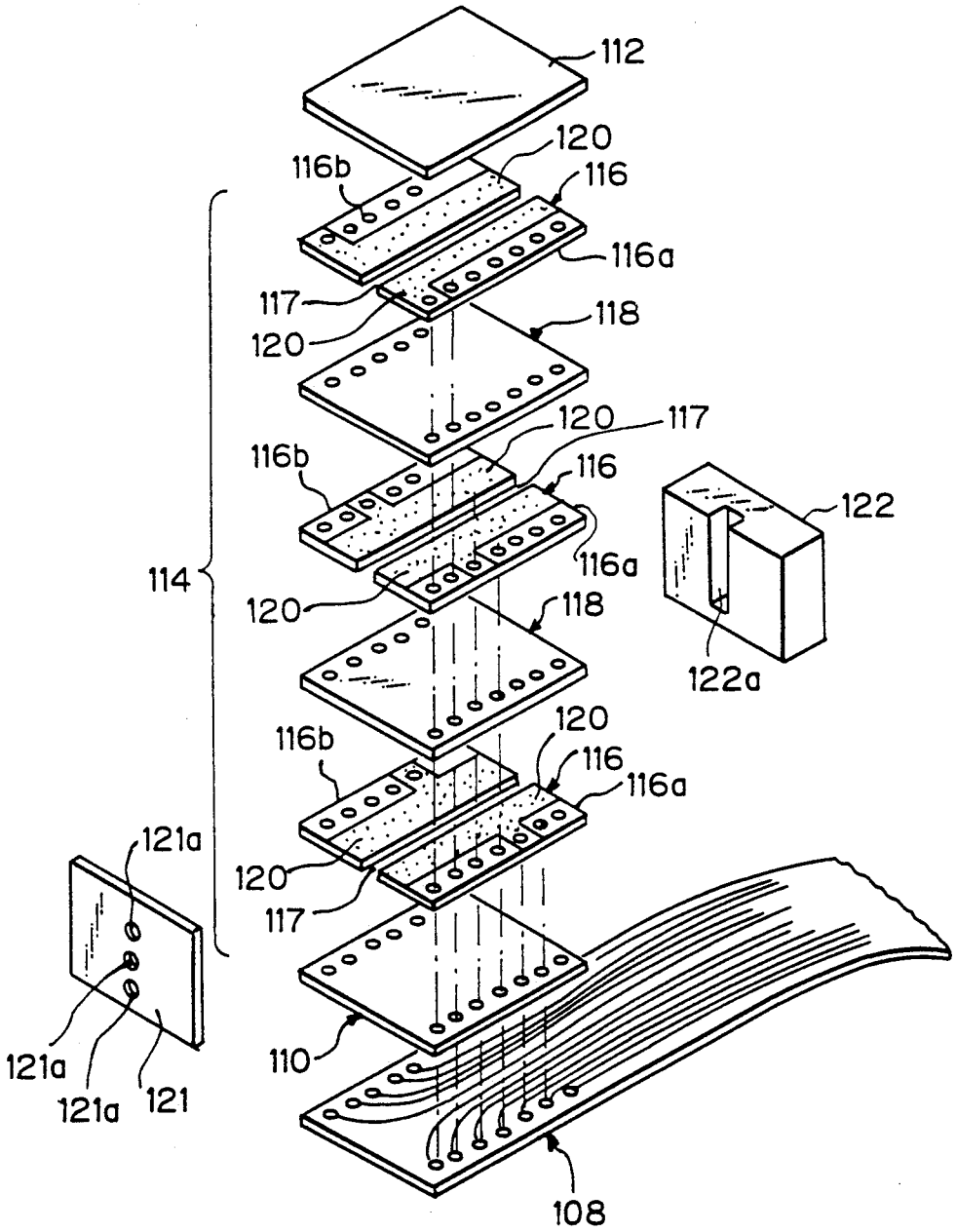
FIG. 17 is an exploded view showing a fifth embodiment of an ink-jet printing head according to the present invention.

FIG. 17 shows a fifth embodiment of an ink-jet printing head according to the present invention. This ink-jet printing head comprises: a flexible wiring sheet 108 constructed in substantially the same manner as the flexible wiring sheet 12; a laminated unit including a bottom insulating plate element 110, a top insulating plate element 112, and a lamination core 114 disposed therebetween. The bottom and top insulating plate elements 110 and 112 are constructed in substantially the same manner as the bottom and top insulating plate elements 14 and 16 of the first embodiment (FIG. 1).

For simplicity, although the lamination core 114 is shown to include three piezoelectric plate elements 116 and two intermediate insulating plate elements 118, it may be formed by more than three piezoelectric plate elements 116 and by more than two intermediate insulating plate elements 118. Each of the piezoelectric plate elements 116 comprises a pair of pieces 116*a* and 116*b* spaced from each other to form a passage 117 therebetween. The piezoelectric plate elements 116 and the intermediate insulating plate elements 118 are alternately laminated in such a manner that the two piezoelectric plate elements are positioned at the bottom and top of the lamination core 114. Namely, in the lamination core 114, the number of intermediate insulating plate elements is less than the number of piezoelectric plate elements, by one. Each of the strip pieces 116*a* and 116*b* is provided with upper and lower electrode layers formed on the upper and lower surfaces thereof. In FIG. 17, the upper electrode layer is indicated by reference numeral 120; the lower electrode layer is not visible. The upper and lower electrode layers are extended along the passage 117.

The laminated unit including the bottom insulating plate element 110, the top insulating plate element 112, and the lamination core 114 disposed therebetween, is integrally formed as a sintered ceramic product, such as a PZT product, in substantially the same manner as in the first embodiment. As apparent from FIG. 17, an orifice plate element 121*a* having three orifices 121*a* formed therein is attached to a front end face of the laminated unit with a suitable adhesive, so that the orifices 121*a* are aligned with the passages 117. Also, an ink reservoir block element 122 having a groove 122*a* formed therein is attached to a rear end face of the laminated unit with a suitable adhesive, so that the groove 122*a* is communicated with the passage 117. Note, the groove 122*a* of the block element 122 also serves as an ink reservoir. When the orifice plate element 121 and the ink reservoir block element 122 are formed of a suitable ceramic material, they may be sintered together with the laminated unit.

The ink-jet printing head is finished by fixing the laminated unit to the flexible wiring sheet 108, in place, with a suitable adhesive. In this ink-jet printing head, each of the passages 117 of the piezoelectric plate elements 116 form a pressure chamber filled with an ink supplied from the ink reservoir 122*a*. The upper and lower electrode layers of the piezoelectric plate elements 116 (strip pieces 116*a*, 116*b*) are electrically connected to terminal pads of the flexible wiring sheet 108 in substantially the same manner as in the first embodiment. Also, each of the piezoelectric plate elements 98 is polarized in the same manner as in the first embodiment.

According to the fifth embodiment shown in FIG. 17, when the laminated unit is obtained as the sintered ceramic product, it can be easily and visually inspected because the fine passages 117 of the laminated unit are open at both ends. Namely, it can be rapidly determined whether or not the fine passages 117 are clear.

Figure 18:
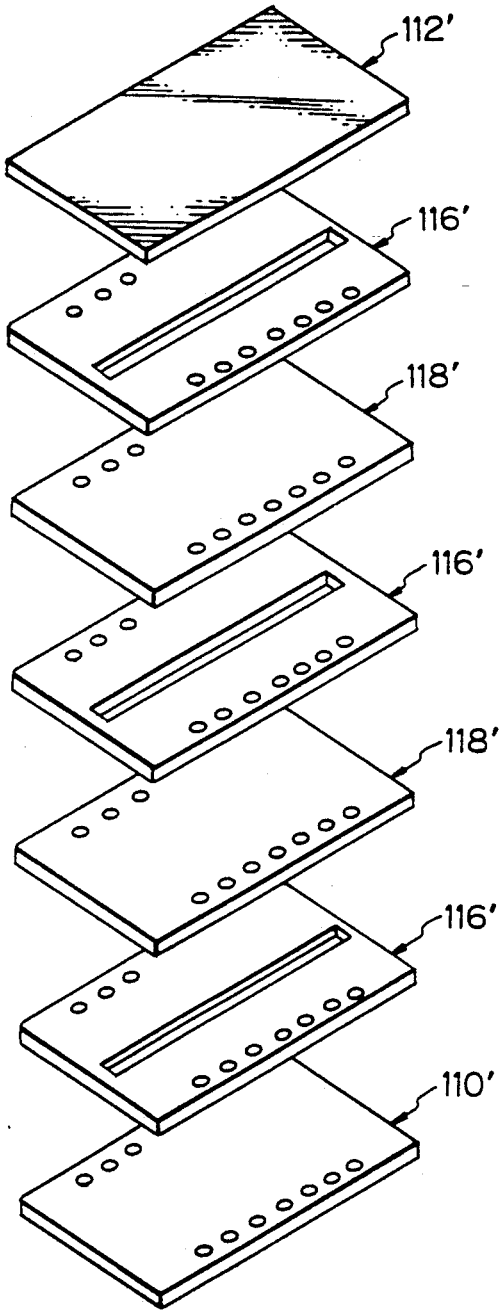
FIG. 18 is an exploded view showing a green sheet assembly for easily producing a laminated unit of the ink-jet printing printer of FIG. 17.

FIG. 18 shows a preferable green sheet assembly for obtaining the laminated unit. The green sheet assembly includes a shaped green sheet 110' for the bottom insulating plate element 110, a shaped green sheet 112' for the top insulating plate element 112, three shaped green sheets 116' for the piezoelectric sheet elements 116, and two shaped green sheets 118' for the intermediate insulating plate elements 118. Since each of the shaped green sheets 116' has a closed passage 117' formed therein, it can be easily positioned during a formation of the green sheet assembly. Note, the shaped green sheets 116' are previously spread with a conductive paste, for the formation of the upper and lower electrode layers. After the green sheet assembly is sintered, end portions of the sintered ceramic product are cut therefrom, so that each of the closed passages 117' is open at both ends, and thus the desired laminated unit can be obtained.

Figure 19:
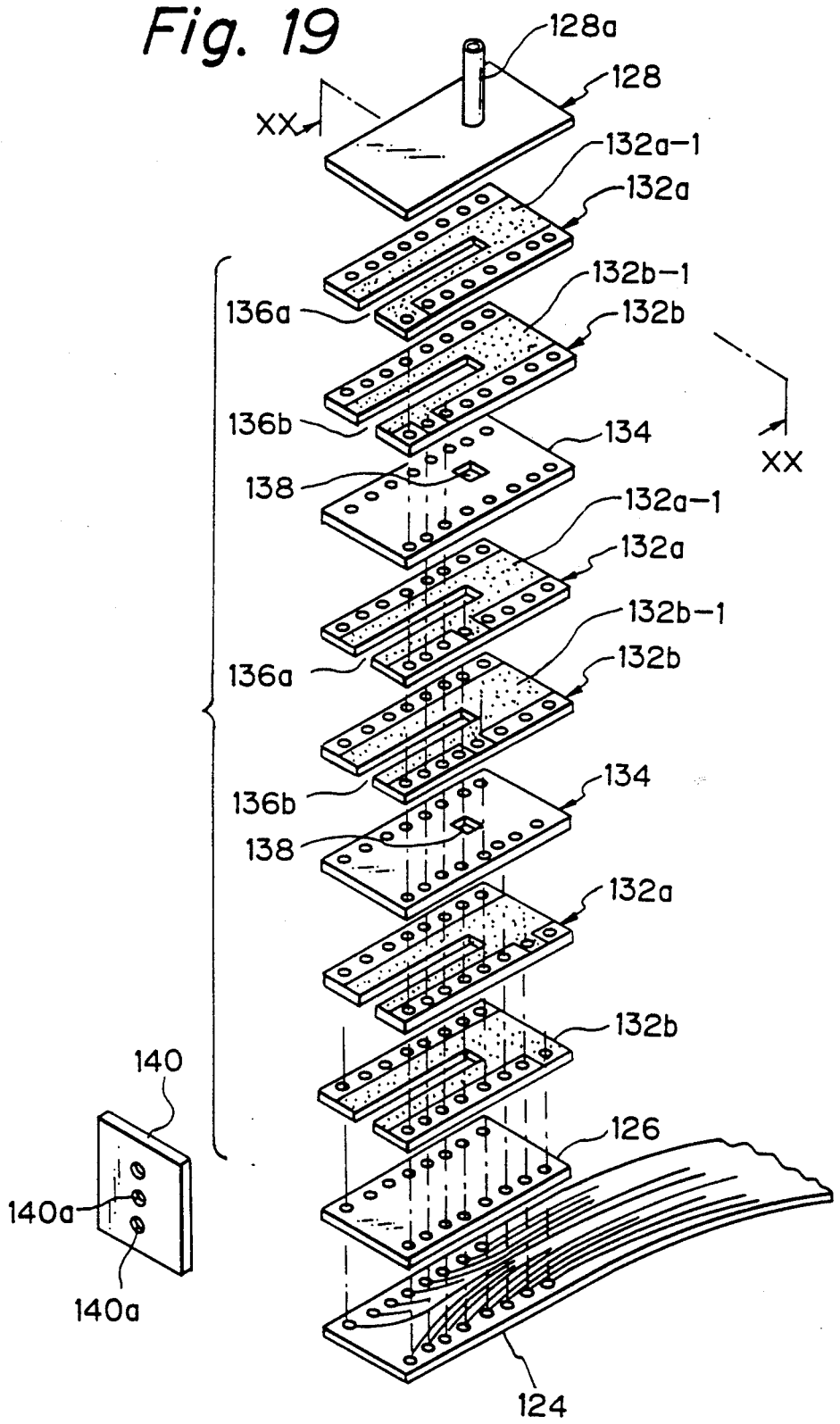
FIG. 19 is an exploded view showing a sixth embodiment of an ink-jet printing head according to the present invention.
Figure 20:
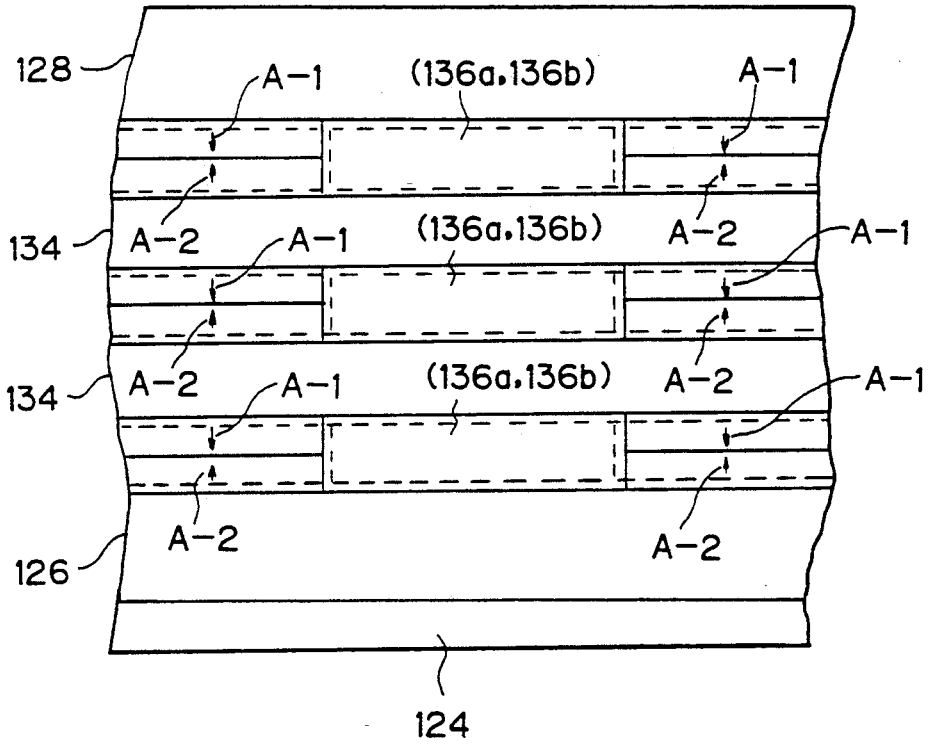
FIG. 20 is a cross sectional view taken along a line XX—XX of FIG. 19.
Figure 21:
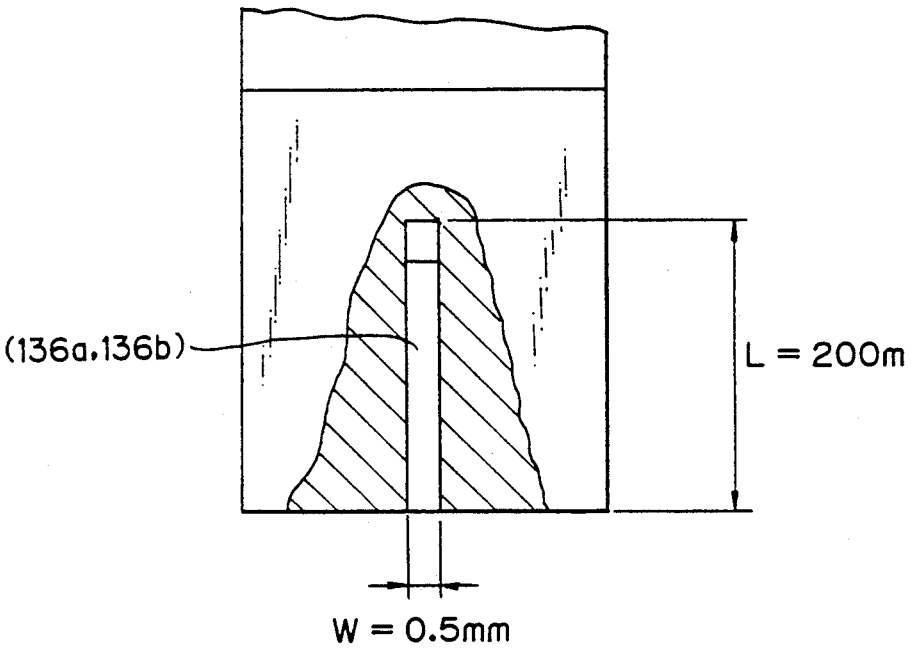
FIG. 21 is a schematic plane view showing a piezoelectric plate element used in the ink-jet printing head of FIG. 19.

FIGS. 19 to 21 show a sixth embodiment of an ink-jet printing head according to the present invention. This ink-jet printing head comprises: a flexible wiring sheet 124 constructed in substantially the same manner as the flexible wiring sheet 12; a laminated unit including a bottom insulating plate element 126, a top insulating plate element 128, and a lamination core 130 disposed therebetween. The bottom and top insulating plate elements 126 and 128 are constructed in substantially the same manner as the bottom and top insulating plate elements 14 and 16 of the first embodiment (FIG. 1).

For simplicity, although the lamination core 130 is shown to include three pairs of piezoelectric plate elements 132*a* and 132*b*, and two intermediate insulating plate elements 134, it may further include more than three pairs of piezoelectric plate elements 132*a* and 132*b* and more than two intermediate insulating plate elements 134, as long as the number of pairs of piezoelectric plate elements is more than that of the intermediate insulating plate elements, by one. The piezoelectric plate elements 132*a* and 132*b* have elongated opening 136*a* and 136*b* formed therein, respectively, each of which is open to the outside at one end thereof. The elongated openings 136*a* and 136*b* of each pair of piezoelectric plate elements 132*a* and 132*b* are identical to and in register with each other. The three pairs of piezoelectric plate elements 132*a* and 132*b* and the two intermediate insulating plate elements 134 are alternately laminated in such a manner that the two pairs of piezoelectric plate elements are positioned at the bottom and top of the lamination core 130. Each pair of piezoelectric plate elements 132*a* and 132*b* is provided with two outer electrode layers formed on an outer surface of the piezoelectric plate element 132*a* and a lower surface of the piezoelectric plate element 132*b*, respectively, and an intermediate electrode layer between the piezoelectric plate elements 132*a* and 132*b*. In FIG. 19, one of the two outer electrode layers (i.e., the electrode layer formed on the upper surface of the piezoelectric plate element 132*a*) is indicated by reference numeral 132*a*-1; the intermediate electrode layer is indicated by reference numeral 132*b*-1; and the other outer electrode layer (i.e., the electrode layer formed on the lower surface of the piezoelectric plate element 132*b*) is not visible. Note, the intermediate electrode layer may be formed on the lower surface of the piezoelectric plate element 132*a*. The outer electrode layer 132*a*-1 is extended to surround the elongated opening 136*a*, and the intermediate electrode layer 132*b*-1 and the other outer electrode layer (not visible) are extended to surround the corresponding elongated opening 136*b*. Each of the intermediate insulating plate elements 134 has a rectangular opening 138 formed therein.

The laminated unit including the bottom insulating plate element 126, the top insulating plate element 128, and the lamination core 130 disposed therebetween, is integrally formed as a sintered ceramic product, such as a PZT product, in substantially the same manner as in the first embodiment. As apparent from FIG. 19, an orifice plate element 140 having three orifices 140*a* formed therein is attached to a front end face of the laminated unit with a suitable adhesive, so that the orifices 140*a* are aligned with the opened ends of the registered elongated openings 136*a* and 136*b* of the three pairs of piezoelectric plate elements 132*a* and 132*b*, respectively. If the orifice plate element 140 is formed of a suitable ceramic material, it may be sintered together with the laminated unit.

The ink-jet printing head is finished by fixing the laminated unit to the flexible wiring sheet 124, in place with a suitable adhesive. In this ink-jet printing head, the rectangular openings 138 of the intermediate insulating plate elements 134 cooperate with the closed end zones of the three registered elongated openings (136*a*, 136*b*) to form an ink reservoir to which ink is supplied through an inlet pipe element 128*a* of the top insulating plate element 128, which is connected to an ink source (not shown) through a suitable flexible tube (not shown). The registered elongated openings 136*a* and 136*b* of each pair of piezoelectric plate elements 132*a* and 132*b* cooperate with each other to form a pressure chamber filled with ink supplied from the ink reservoir. The upper electrode layers of the piezoelectric plate elements 132*a* and the upper and lower electrode layers of the piezoelectric plate elements 132*b* are electrically connected to terminal pads of the flexible wiring sheet 124 in substantially the same manner as in the first embodiment.

According to this sixth embodiment, although each of the intermediate insulating plate elements 134 is formed as a ceramic product having a potential piezoelectric effect, it is possible to simultaneously polarize all of the piezoelectric plate elements 132*a* and 132*b*, because the poling voltage can be applied to all of the piezoelectric plate elements 132*a* and 132*b* in such a manner that all of the outer electrode layers thereof have either of a positive or negative polarity, and all of the intermediate electrode layers have an opposite polarity. In particular, during the application of the poling voltage, since the two electrode layers having the intermediate insulating plate elements 134 intervened therebetween have the same electric potential, no electric field is generated between the two electrode layers concerned. Thus, although a simultaneous poling is carried out for all of the piezoelectric plate elements 132*a* and 132*b*, the intermediate insulating plate elements 134 cannot be polarized.

According to the poling as mentioned above, for example, as shown in FIG. 20, all of the piezoelectric plate elements 132*a* are polarized in the same direction indicated by arrows A-1, and all of the piezoelectric plate elements 132*b* are polarized in the same direction indicated by arrows A-2. Accordingly, when a pulse voltage is applied to the pair of piezoelectric plate elements 132*a* and 132*b*, so that an electric field generated in the piezoelectric plate element 132*a* is reversely oriented with respect to the direction of poling (A-1) and an electric field generated in the piezoelectric plate element 132*b* is reversely oriented with respect to the direction of poling (A-2), a thicknesses of the pair of piezoelectric plate elements 132*a* and 132*b* is reduced as indicated by broken lines in FIG. 20, and thus the volume of the pressure chamber (136*a*, 136*b*) is reduced.

In this sixth embodiment, when the pair of piezoelectric plate elements 132*a* and 132*b* are PZT, and when a drive pulse voltage is 12.5 V, the pressure chambers (136*a*, 136*b*) preferably have a length L of 20 mm and a width W of 0.5 mm, as shown in FIG. 21, for the following reasons:

When each pair of piezoelectric plate elements 132*a* and 132*b* is PZT, a piezoelectric constant $d_{33}$ thereof in the direction of thickness of the piezoelectric plate element is as shown below:

$$d_{33} 4 \times 10^{-10}\ m/V$$

When the drive pulse voltage of 12.5 V is applied to each pair of piezoelectric plate elements 132*a* and 132*b*, a change of thickness δ of each piezoelectric plate element (132*a*, 132*b*) is as shown below:

$$\delta = 0.005\ \mu m$$

Note, the value of δ is not related to a thickness of each piezoelectric plate element (132*a*, 132*b*).

Accordingly, a change of volume δ P of the pressure chamber is as defined below:

$$\delta P = 2\delta \times W \times L$$

Since W=0.5 mm, and L=20 mm, $$\delta P = 1 \times 10^{-4}\ mm^3$$

If an ink-jet drop ejected from the orifice 140a has a diameter of 30 μm, $$Q = 1.4 \times 10^{-5}\ mm^3$$

wherein Q is a volume of the ink-jet drop.

Accordingly, a ratio of δ P to Q is 7.

This proves that the change of volume of the pressure chamber is sufficient to ensure the ejection of the ink-jet drop. Note, preferably a diameter of the orifices 140a is about 30 μm.

Note, although the pressure chamber (136a, 136b) has the same dimension as the pressure chamber 102 of the fourth embodiment (FIG. 16), the value (12.5 V) of the drive pulse voltage is one half of 25 V.

In the sixth embodiment, preferably each pair of piezoelectric plate elements 132a and 132b has substantially the same thickness as each of the intermediate insulating plate elements 134. For example, when a thickness of the intermediate insulating plate elements 134 is about 42 μm, the orifices 140a are disposed at a pitch of about 84 μm, so that a printing can be carried out at about 300 dpi.

Figure 22:
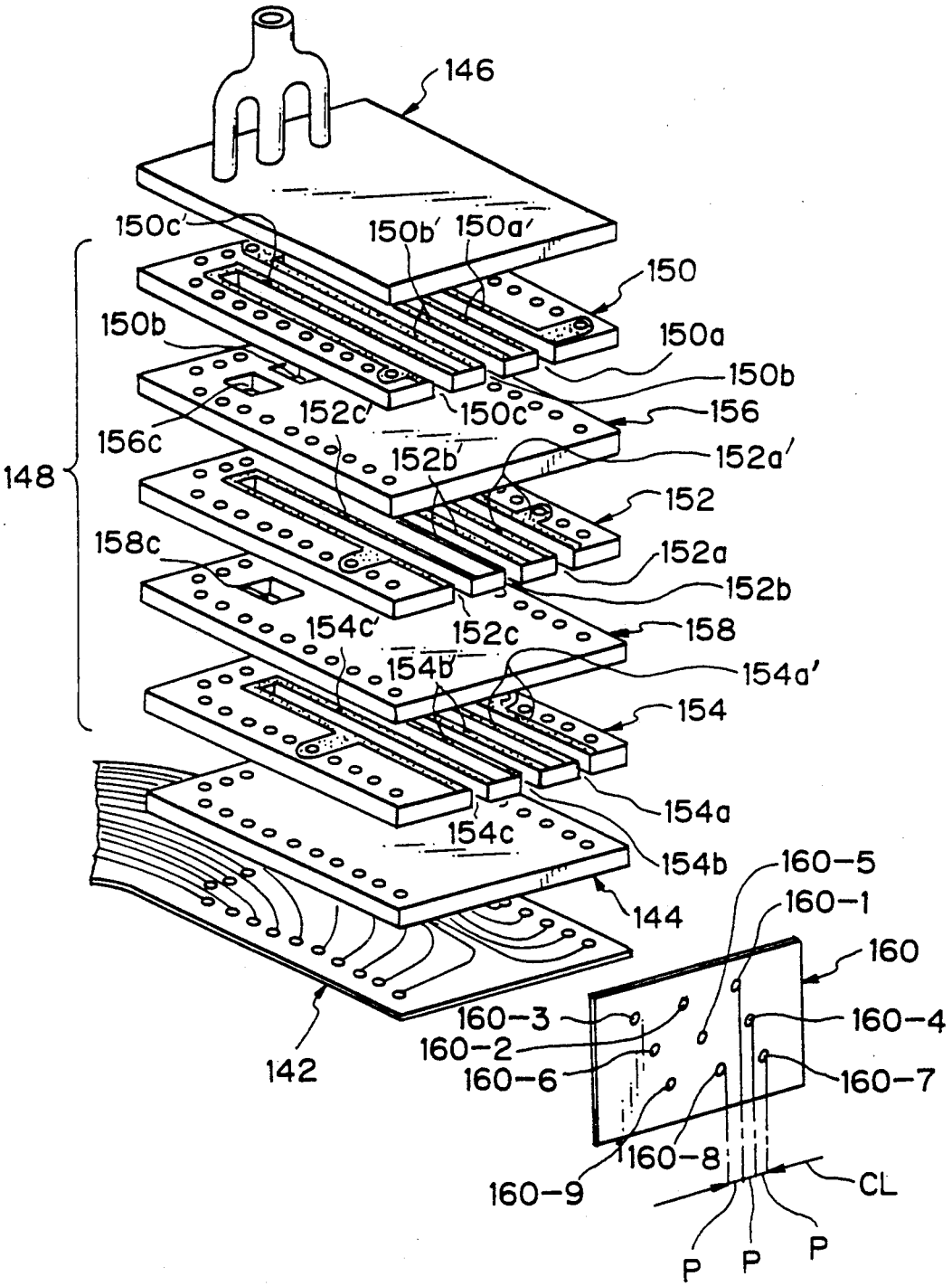
FIG. 22 is an exploded view showing a seventh embodiment of an ink-jet printing head according to the present invention.

FIG. 22 shows a seventh embodiment of an ink-jet printing head according to the present invention, which is arranged as a model suitable for an ink-jet line printer. This ink-jet printing head comprises: a flexible wiring sheet 142 constructed in substantially the same manner as the flexible wiring sheet 12; a laminated unit including a bottom insulating plate element 144, a top insulating plate element 146, and a lamination core 148 disposed therebetween. The bottom and top insulating plate elements 144 and 146 are constructed in substantially the same manner as the bottom and top insulating plate elements 14 and 16 of the first embodiment (FIG. 1).

The lamination core 148 includes three piezoelectric plate elements 150, 152 and 154, and two intermediate insulating plate elements 156 and 158, which are alternately laminated in such a manner that the two piezoelectric plate elements 150 and 154 are positioned at the bottom and top of the lamination core 148, respectively, as shown in FIG. 22.

The piezoelectric plate elements 150, 152 and 154 have three elongated passages 150a, 150b and 150c, three elongated passages 152a, 152b and 152c, and three elongated passages 154a, 154b and 154c, respectively, and each of these passages is open at one end thereof. The elongated passages 150a, 150b and 150c; 152a, 152b and 152c; and 154a, 154b and 154c are laterally disposed, at a regular spacing, and extend in parallel with each other. The piezoelectric plate elements 150 is provided with three upper electrode layers and three lower electrode layers formed on upper and lower surfaces thereof to surround the elongated passages 150a, 150b and 150c, respectively; in FIG. 22, the upper electrode layers are indicated by reference numeral 150a', 150b' and 150c'; the lower electrode layers are not visible. Also, the piezoelectric plate elements 152 is provided with three upper electrode layers and three lower electrode layers formed on upper and lower surfaces thereof to surround the elongated passages 152a, 152b and 152c, respectively; in FIG. 22, the upper electrode layers are indicated by reference numeral 152a', 152b' and 152c', but the lower electrode layers are not visible. Similarly, the piezoelectric plate elements 154 is provided with three upper electrode layers and three lower electrode layers formed on upper and lower surfaces thereof to surround the elongated passages 154a, 154b and 154c, respectively; in FIG. 22, the upper electrode layers are indicated by reference numeral 154a', 154b' and 154c', but the lower electrode layers are not visible.

The intermediate insulating plate elements 156 has three rectangular openings formed therein communicating with the elongated passages 150a, 150b and 150c; and 152a, 152b and 152c, respectively; in FIG. 22, only two of these rectangular openings indicated by reference numerals 156b and 156c are shown, and the other rectangular opening is not visible. Also, the intermediate insulating plate elements 158 have rectangular openings formed therein and communicated with the elongated passages 152a, 152b and 152c; and 154a, 154b and 154c, respectively; in FIG. 22, only one of these rectangular openings is indicated by reference numeral 158c, and the other rectangular openings are not visible.

The laminated unit including the bottom insulating plate element 144, the top insulating plate element 146, and the lamination core 148 disposed therebetween, is integrally formed as a sintered ceramic product such as a PZT product in substantially the same manner as in the first embodiment. As is apparent from FIG. 22, an orifice plate element 160 having nine orifices 160-1 to 160-9 formed therein is attached to a front end face of the laminated unit with a suitable adhesive, so that the orifices 160-1, 160-2, 160-3, 160-4, 160-5, 160-6, 160-7, 160-8 and 160-9 are aligned with the open ends of the elongated passages 150a, 150b and 150c; 152a, 152b and 152c; and 154a, 154b and 154c, respectively. This means that an arrangement of the elongated passages 150a, 150b and 150c; 152a, 152b and 152c; and 154a, 154b and 154c corresponds to that of the orifices 160-1, 160-2, 160-3, 160-4, 160-5, 160-6, 160-7, 160-8 and 160-9.

Note, if the orifice plate element 160 is formed of a suitable ceramic material, it may be sintered together with the laminated unit.

The ink-jet printing head is finished by fixing the laminated unit to the flexible wiring sheet 142, in place, with a suitable adhesive. In this ink-jet printing head, the rectangular opening 156c of the intermediate insulating plate elements 156 and the rectangular opening 158c of the intermediate insulating plate elements 158 cooperate with the closed end zones of the elongated openings 150c, 152c and 150c, to form an ink reservoir; the rectangular opening 156b of the intermediate insulating plate elements 156 and the corresponding rectangular opening (not visible) of the intermediate insulating plate elements 158 cooperate with the closed end zones of the elongated openings 150b, 152b and 150b, to form an ink reservoir; and the rectangular opening (not visible) of the intermediate insulating plate elements 156 and the corresponding rectangular opening (not visible) of the intermediate insulating plate elements 158 cooperate with the closed end zones of the elongated openings 150a, 152a and 150a, to form an ink reservoir. These ink reservoirs are supplied with ink through an inlet pipe element 146a of the top insulating plate element 146, which is connected to an ink source (not shown). Each of the elongated passages 150*a*, 150*b* and 150*c*; 152*a*, 152*b* and 152*c*; and 154*a*, 154*b* and 154*c* forms a pressure chamber filled with ink supplied from the corresponding ink reservoir. The upper layers 150*a*', 150*b*' and 150*c*'; 152*a*', 152*b*' and 152*c*'; and 154*a*', 154*b*' and 154*c*' and the corresponding lower layers (not visible) are electrically connected to terminal pads of the flexible wiring sheet 142, in substantially the same manner as in the first embodiment. Also, each of the piezoelectric plate elements 150, 152 and 154 is polarized in the same manner as in the first embodiment. When a drive pulse voltage is applied between each of the upper layers and the corresponding lower layer, a thickness of the piezoelectric plate element concerned is locally reduced, resulting in a decrease of a volume of the pressure chamber concerned, whereby an ink-jet drop is ejected from the corresponding orifice.

As shown in FIG. 22, when the locations of the orifices 160-7, 160-4, 160-1, and 160-8 are projected onto a common line CL, these projected locations are aligned at a given pitch of P. This also is true for the other orifices 160-5, 160-2, 160-9, 160-6, and 160-3. Namely, the pitch of P represents a dot pitch at which a printing is carried out by the ink-jet printing head.

Figure 23:
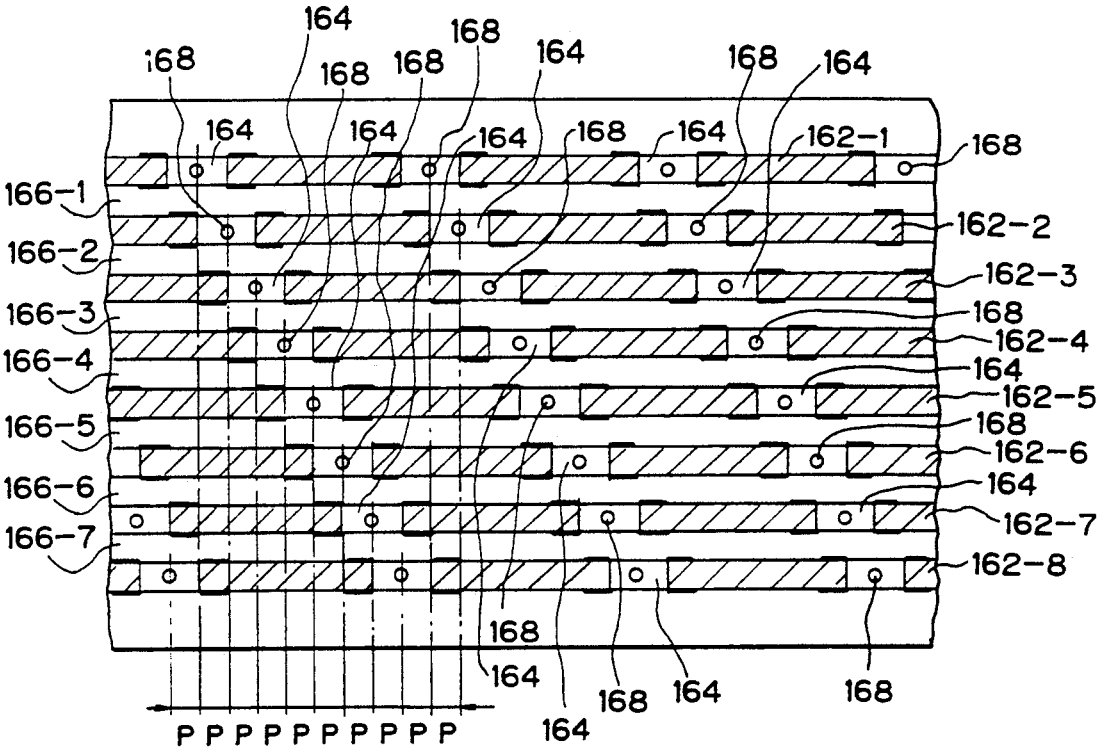
FIG. 23 is a partial front view of an ink-jet printing head from which an orifice plate element is removed.

FIG. 23 shows a part of an ink-jet printing head constructed on the basis of the seventh embodiment of FIG. 22, and can be used in an actual ink-jet line printer. This ink-jet printing head comprises eight piezoelectric plate elements 162-1 to 162-8, in each of which a plurality of elongated passages or pressure chambers 164 are formed. Note, these piezoelectric plate elements 162-1 to 162-8 are formed in substantially the same manner as the piezoelectric plate element 150, 152, 154. Also, seven intermediate insulating plate elements 166-1 to 166-7, which are alternately laminated with the piezoelectric plate elements 162-1 to 162-8, are formed in substantially the same manner as the intermediate insulating plate element 156, 158. In FIG. 23, reference numeral 168 indicates an orifice location, and reference numerals 170 and 172 indicate bottom and top insulating plate elements corresponding to the bottom and top insulating plate elements 144 and 146, respectively.

According to the present invention, it is possible to precisely and easily arrange the plurality of elongated passages or pressure chambers 164 at a low cost, because shaped green sheets for the piezoelectric plate elements, the intermediate insulating plate elements, and other elements can be obtained from the green sheet material by using punch cutting dies, as mentioned above.

Figure 24:
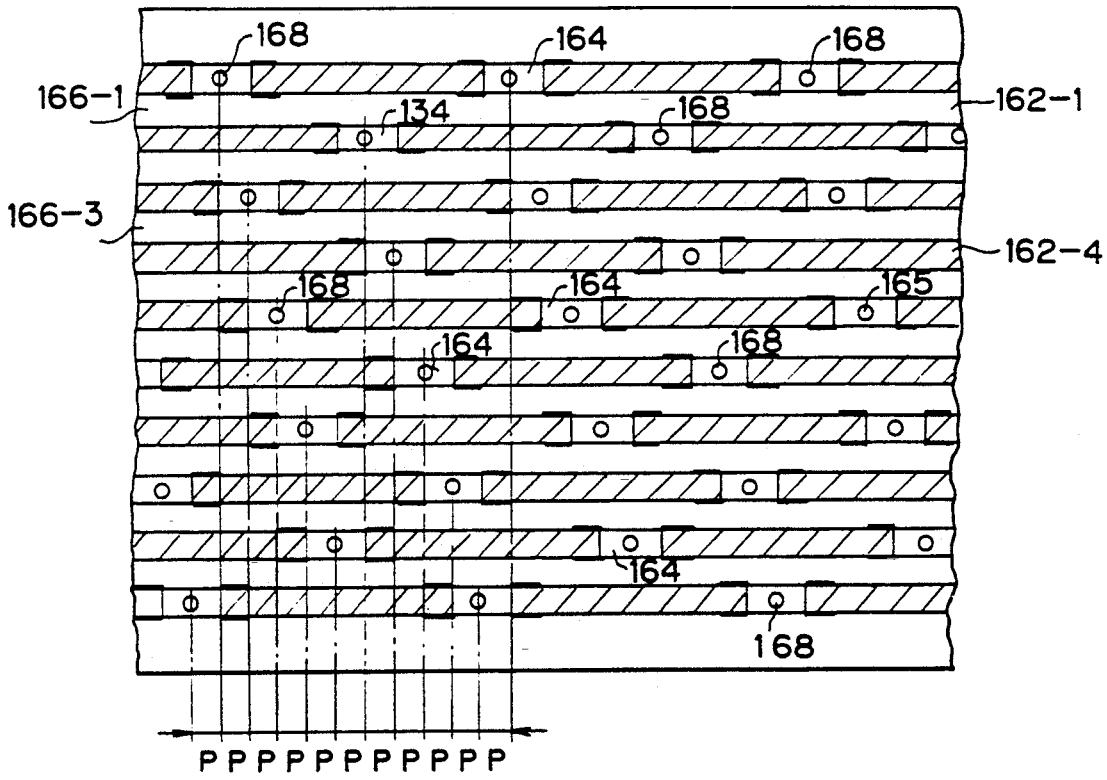
FIG. 24 is a view showing a modification of FIG. 23.

FIG. 24 shows a modification of the embodiment shown in FIG. 23. In this drawing, the elements similar to those of FIG. 23 are indicated by the same reference numerals. This modified embodiment is identical to the embodiment of FIG. 23 except that the pressure chambers are arranged in a different manner.

Figure 25:
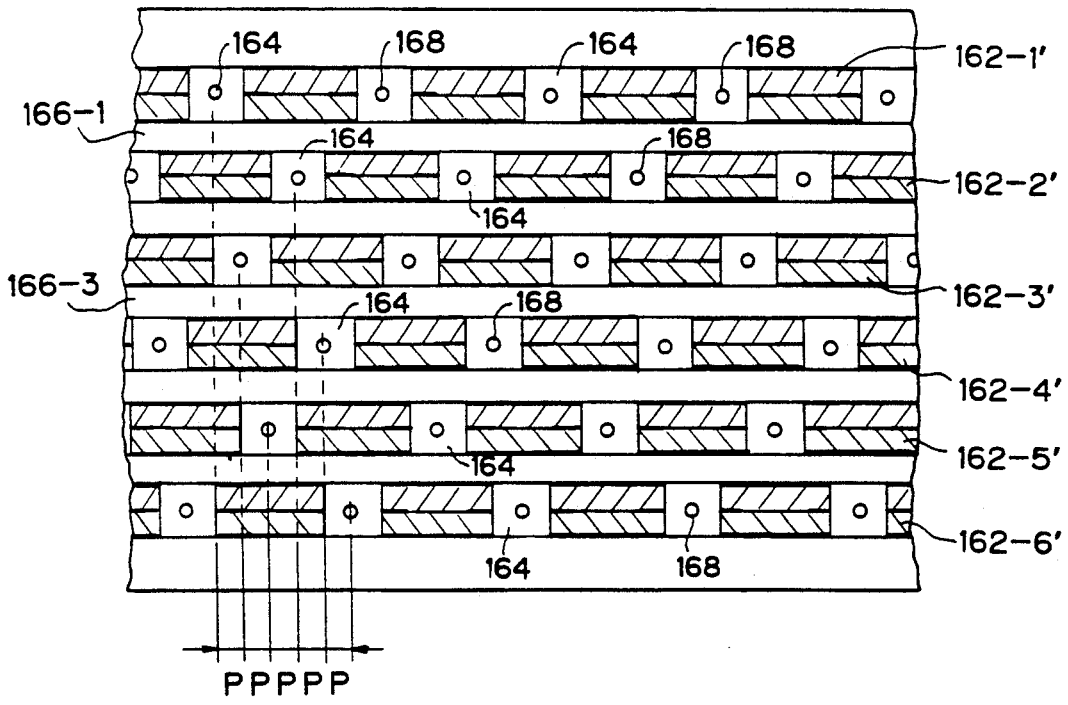
FIG. 25 is a view showing another modification of FIG. 23.

FIG. 25 shows another modification of the embodiment shown in FIG. 23. In this modified embodiment, the pressure chambers are arranged in substantially the same manner as in FIG. 24, but six pair of piezoelectric plate elements 162-1' to 162-6', as explained with reference to FIG. 19, are used in place of the eight piezoelectric plate elements 162-1 to 162-8.

Finally, it will be understood by those skilled in the art that the foregoing description is of several preferred embodiments of the disclosed printing head, and that various changes and modifications may be made to the present invention without departing from the spirit and scope thereof.

We claim:

1. An ink-jet printing head for a serial ink-jet printer, comprising:

a laminated unit integrally formed as a sintered ceramic product, said laminated unit including a bottom insulating plate element, a top insulating plate element, and a piezoelectric plate element between said bottom and top insulating plate element, said piezoelectric plate element being configured to define a pressure chamber in said laminated unit, the pressure chamber having a volume corresponding to a thickness of said piezoelectric plate element fillable with ink, said piezoelectric plate element having opposite surfaces, an electrode layer formed on each of said opposite surfaces surrounding said pressure chamber, said laminated unit having an orifice in communication with said pressure chamber; and means for applying a drive pulse voltage to said piezoelectric plate element through each said electrode layer to reduce the thickness of said piezoelectric plate element, resulting in a decrease in the volume of the pressure chamber, to eject an ink-jet drop from said orifice.

2. An ink-jet printing head as set forth in claim 1, wherein the laminated unit includes the orifice.

3. An ink-jet printing head as set forth in claim 1, wherein the sintered ceramic product includes an orifice plate element attached to said laminated unit, said orifice plate element having the orifice formed therein.

4. An ink-jet printing head as set forth in claim 1, wherein said laminated unit includes an ink reservoir in communication with said pressure chamber for supplying ink to the pressure chamber.

5. An ink-jet printing head as set forth in claim 1, wherein the sintered ceramic product includes an ink reservoir block attached to said laminated unit, said block having a reservoir in communication with said pressure chamber to supply ink to said pressure chamber.

6. An ink-jet printing head as set forth in claim 1, wherein said drive pulse applying means includes two throughholes extending through the piezoelectric plate element and the bottom plate insulating element of said laminated unit, each of said throughholes having a conductive lining, each electrode layer of said piezoelectric plate element being partially extended to surround a respective one of said throughholes so that each of said electrode layer is electrically connected to the conductive lining of a corresponding one of said throughholes.

7. An ink-jet printing head as set forth in claim 6, wherein said drive pulse applying means further includes a wiring sheet having two terminal pads, said laminated unit being fixed to said wiring sheet so that the conductive lining of each of said throughholes is electrically connected to a corresponding one of said terminal pads.

8. An ink-jet printing head for a serial ink-jet printer comprising:

a laminated unit integrally formed as a sintered ceramic product, said laminated unit including a bottom insulating plate element, a top insulating plate element and a lamination core between said bottom and top insulating plate element, said lamination core having at least tow piezoelectric plate elements and at least one intermediate insulating plate element, said at least two piezoelectric plate elements and said at least one intermediate insulating plate element being alternatively laminated, said laminated unit having a plurality of pressure chambers defined by said at least two piezoelectric plate elements fillable with ink, each of said pressure chambers having a volume corresponding to a thickness of a respective one of said at least two piezoelectric plate elements, an electrode layer formed on opposite surfaces of said at least two piezoelectric plate elements surrounding a corresponding pressure chamber, said laminated unit having orifices communicating with respective pressure chambers; and means for applying a drive pulse voltage to each of said at least two piezoelectric plate elements through each corresponding electrode layer to reduce the thickness of a respective one of said at least two piezoelectric plate elements resulting in a decrease in the volume of a corresponding one of the pressure chambers to eject an ink-jet drop from a corresponding orifice.

9. An ink-jet printing head as set forth in claim 8, wherein said laminated unit includes each of said orifices.

10. An ink-jet printing head as set forth in claim 8, wherein said sintered ceramic product includes an orifice plate element attached to said laminated unit, said orifice plate element including each of said orifices.

11. An ink-jet printing head as set forth in claim 8, wherein said laminated unit includes an ink reservoir in communication with said pressure chambers to supply ink to said pressure chambers.

12. An ink-jet printing head as set forth in claim 8, wherein said laminated unit includes an ink reservoir block having an ink reservoir, said ink reservoir block being attached to said laminated unit with said ink reservoir in communication with said pressure chambers to supply ink to the pressure chambers.

13. An ink-jet printing head as set forth in claim 8, wherein said drive pulse applying means includes at least four throughholes extending through the at least two piezoelectric plate elements, the at least one intermediate insulating plate member, and the bottom plate insulating element of said laminated unit, each of said at least four throughholes having a conductive lining, each electrode layer of said at least two piezoelectric plate elements being partially extended to surround a respective one of said throughholes so that each said electrode layer is electrically connected to the conductive lining of a corresponding one of the at least four throughholes.

14. An ink-jet printing head as set forth in claim 13, wherein said drive pulse applying means further includes a wiring sheet having at least four terminal pads formed thereon, said laminated unit being fixed to said wiring sheet so that each conductive lining of said throughholes is electrically connected to a respective one of said terminal pad.

15. An ink-jet printing head for a serial ink-jet printer comprising:

a laminated unit, having a longitudinally extending central axis, integrally formed as a sintered ceramic product said laminated unit including a bottom insulating plate element, a top insulating plate element and a lamination core between said bottom and top insulating plate element, said laminated core having at least two piezoelectric plate elements and an insulating layer disposed therebetween, said laminated unit having pressure chambers defined by each of said at least two piezoelectric plate elements fillable with ink, said pressure chambers being symmetrically disposed with respect to the longitudinal central axis of said laminated unit so as to be spatially isolated from each other, each of said at least two piezoelectric plate elements having an electrode layer formed on opposite surfaces surrounding a respective pressure chamber, said laminated unit including an orifice in communication with each of said pressure chambers; and means for applying a drive pulse voltage to each of said at least two piezoelectric plate elements through the electrode layer to reduce a thickness of a respective piezoelectric plate element, resulting in a decrease in volume of a corresponding pressure chamber to eject an ink-jet drop from a corresponding orifice.

16. An ink-jet printing head as set forth in claim 15, wherein said laminated unit includes said orifice.

17. An ink-jet printing head as set forth in claim 15, wherein said sintered product includes an orifice plate element attached to said laminated unit, the orifice plate element having orifices formed therein.

18. An ink-jet printing head as set forth in claim 15, wherein said laminated unit includes an ink reservoir in communication with said pressure chambers to supply ink to said pressure chambers.

19. An ink-jet printing head as set forth in claim 15, wherein said sintered product includes an ink reservoir block having an ink reservoir, said ink reservoir block being attached to said laminated unit with the ink reservoir in communication with said pressure chambers to supply ink to the pressure chambers.

20. An ink-jet printing head as set forth in claim 15, wherein said drive pulse applying means includes at least four throughholes extending through the piezoelectric plate elements, the insulating layer, and the bottom plate insulating element of said laminated unit, each of said throughholes having a conductive lining, the electrode layer of each of the said at least four piezoelectric plate elements being partially extended to surround a respective one of said throughholes so that each said electrode layer is electrically connected to the conductive lining of a corresponding one of said throughholes.

21. An ink-jet printing head as set forth in claim 20, wherein said drive pulse applying means further includes a wiring sheet having at least four terminal pads, said laminated unit being fixed to said wiring sheet so that each conductive lining of said at least four throughholes is electrically connected to one of said terminal pads.

22. An ink-jet printing head for a serial ink-jet printer comprising:

a laminated unit, having a longitudinal central axis, integrally formed as a sintered ceramic product, said laminated unit including a bottom insulating plate element, a top insulating plate element and a lamination core between said bottom and top insulating plate element, the lamination core having at least two piezoelectric plate elements, each of said at least two piezoelectric plate elements having opposite surfaces, said at least two piezoelectric plate elements having opposing surfaces, said laminated unit having pressure chambers defined by respective ones of said at least two piezoelectric plate elements, fillable with ink, said pressure chambers each having a volume corresponding to a thickness of a respective one of the at least two piezoelectric plate elements and being symmetrically disposed with respect to the longitudinal central axis so as to be spatially isolated from each other, each of said at least tow piezoelectric plate elements having an electrode layer formed on the opposite surfaces surrounding a corresponding pressure chamber, each said electrode layer formed on respective opposing surfaces of said at least two piezoelectric plate elements being extended to be electrically insulated form each other, said laminated unit including an orifice in communication with each of said pressure chambers; and means for applying a drive pulse voltage to each of said at least two piezoelectric plate elements through each electrode layer thereof to reduce the thickness of the respective one of said at least two piezoelectric plate elements, resulting in a decrease in the volume of the corresponding pressure chambers to eject an ink-jet drop from a corresponding orifice.

23. An ink-jet printing head as set forth in claim 22, wherein said laminated unit includes each said orifice.

24. An ink-jet printing head as set forth in claim 22, wherein said sintered product includes an orifice plate element, having said at least two orifices, attached to said laminated unit.

25. An ink-jet printing head as set forth in claim 22, wherein said laminated unit includes an ink reservoir in communication with said pressure chambers to supply ink to said pressure chambers.

26. An ink-jet printing head as set forth in claim 22, wherein said sintered product includes an ink reservoir block, having an ink reservoir, said ink reservoir block being attached to said laminated unit with the ink reservoir in communication with said pressure chambers to supply ink to said pressure chambers.

27. An ink-jet printing head as set forth in claim 22, wherein said drive pulse applying means includes at least four throughholes extending through the at least two piezoelectric plate elements and the bottom plate insulating element of said laminated unit, each of said at least four throughholes having a conductive lining, each electrode layer each of said at least two piezoelectric plate elements being partially extended to surround a respective one of said throughholes so that each said electrode layer is electrically connected to the conductive lining of a corresponding one of said at least four throughholes.

28. An ink-jet printing head as set forth in claim 27, wherein said drive pulse applying means further includes a wiring sheet having at least four terminal pads, said laminated unit being fixed to said wiring sheet so that each conductive lining of said at least four throughholes are electrically connected to a respective one of said terminal pads.

29. An ink-jet printing head for a serial ink-jet printer comprising;

a laminated unit including a bottom insulating plate element, a top insulating plate element, and a lamination core between said bottom and top insulating plate element, said lamination core having at least two piezoelectric plate elements and at least one intermediate insulating plate element having a longitudinally extending central axis, said at least two piezoelectric plate elements and said at least one intermediate insulating plate element being alternatively laminated, said laminated unit having pressure chambers defined by said at least two piezoelectric plate elements fillable with ink, said pressure chambers being alternatively disposed at opposite sides of the longitudinal central axis of said at least one intermediate insulating plate element to thereby enhance a rigidity of said laminated unit, each of said at least two piezoelectric plate elements having an electrode layer formed on opposite surfaces surrounding a corresponding pressure chamber, said laminated unit including an orifice in communication with each of said pressure chambers; and means for applying a drive pulse voltage of each of said at least two piezoelectric plate elements though a respective electrode layer for decreasing a thickness of a respective piezoelectric plate element resulting in a decrease in volume of a corresponding pressure chamber to eject an ink-jet drop from a corresponding orifice.

30. An ink-jet printing head as set forth in claim 29, wherein said laminated unit includes each of said orifice.

31. An ink-jet printing head as set forth in claim 29, wherein the sintered ceramic product includes an orifice plate element, having said orifice formed therein, attached to said laminated unit.

32. An ink-jet printing head as set forth in claim 29, wherein said laminated unit includes an ink reservoir in communication with said pressure chambers to supply ink to said pressure chambers.

33. An ink-jet printing head as set forth in claim 29, wherein the sintered product includes an ink reservoir block, having an ink reservoir, formed therein, said ink reservoir block being attached to said laminated unit with the ink reservoir in communication with said pressure chambers to supply ink to said pressure chambers.

34. An ink-jet printing head as set forth in claim 29, wherein said drive pulse applying means includes at least four throughholes extending through the piezoelectric plate elements, the intermediate insulating plate element, and the bottom plate insulating element of said laminated unit, each of said at lest four throughholes having a conductive lining, each electrode layer of said piezoelectric plate elements being partially extended to surround a respective one of said at least four throughholes so that each said electrode layer is electrically connected to the conductive lining of a respective throughhole.

35. An ink-jet printing head as set forth in claim 34, wherein sad drive pulse applying means further includes a wiring sheet having at least four terminal pads, said laminated unit being fixed to said wiring sheet so that each conductive lining is electrically connected to one of said terminal pads.

36. An ink-jet printing head for a serial ink-jet printer comprising:

a laminated unit integrally formed as a sintered ceramic product, said lamanted unit including a bottom insulating plate element, a top insulating plate element an a lamination core between said bottom and top insulating plate element, said lamination core having at least two piezoelectric plate elements and at least one intermediate insulating plate element, said at least two piezoelectric plate elements and said at least one intermediate insulating plate element being alternately laminated, said laminated unit having elongated pressure chambers defined by said piezoelectric plate elements, fillable with ink, said elongated pressure chambers having a volume corresponding to a thickness of a respective one of the at least two piezoelectric plate elements each of said elongated pressure chambers being open at one end and closed at another end, said at least one intermediate insulating plate element having an opening formed therein cooperating with the closed other end of each of said elongated pressure chambers to form an ink reservoir, each of said at least two piezoelectric plate elements having an electrode layer formed on opposite surfaces surrounding a corresponding one of the elongated pressure chambers;

an orifice plate having at least two orifices formed therein fixed to said laminated unit with each of said at least two orifices being in communication with a respective one of said elongated pressure chambers; and means for applying a drive pulse voltage of each of said at least two piezoelectric plate elements through the respective electrode layer, to reduce the thickness of a respective one of said at least two piezoelectric plate elements, resulting in a decrease in the volume of a corresponding one of the pressure chambers to eject an ink-jet drop from a corresponding orifice.

37. An ink-jet printing head as set forth in claim 36, wherein said drive pulse applying means includes at least four throughholes extending through the piezoelectric plate elements, the intermediate insulating plate element, and the bottom plate insulating element of said laminated unit, each of said at least four throughholes having a conductive lining, the electrode layer of each of said piezoelectric plate elements being partially extended to surround a respective one of said at least four throughholes so that each said electrode layer is electrically connected to the conductive lining of a respective throughhole.

38. An ink-jet printing head as set forth in claim 37, wherein said drive pulse applying means further includes a wiring sheet having at least four terminal pads, said laminated unit being fixed to said wiring sheet so that the conductive lining of each of said at least four throughholes is electrically connected to one of said terminal pads.

39. An ink-jet printing head for a serial ink-jet printer comprising:

a laminated unit integrally formed as a sintered ceramic product, said laminated unit including a bottom insulating plate element, a top insulating plate element, and a lamination core between said bottom and top insulating plate element, said laminated core having at least two piezoelectric plate elements and at least one intermediate insulating plate element, said at least two piezoelectric plate elements and said at least one intermediate insulating plate element being alternately laminated, said laminated unit having elongated pressure chambers defined by said at least two piezoelectric plate elements, and fillable with ink, each of said elongated pressure chambers being open at both ends and having a volume corresponding to a thickness of a respective one of the at least two piezoelectric plate elements, each of said at least two piezoelectric plate elements having an electrode layer formed on opposite surfaces thereof along a corresponding one of the elongated pressure chambers;

an orifice plate having at least two orifices formed therein securely attached to a front end face of said laminated unit with each of said at least two orifices in communication with a respective one of said elongated pressure chambers;

an ink reservoir block having an ink reservoir formed therein attached to a rear end face of said laminated unit with said ink reservoir being in communication with said elongated pressure chambers; and means for applying a drive pulse voltage to each of said at least two piezoelectric plate elements through the respective electrode layer, for reducing the thickness of a respective one of the at least two said piezoelectric plate elements, resulting in a decrease in the volume of a corresponding one of the pressure chambers, said reduction in volume causing an ink-jet drop to be ejected from a corresponding orifice.

40. An ink-jet printing head as set forth in claim 39, wherein said drive pulse applying means includes at least four throughholes extending through the piezoelectric plate elements, the intermediate insulating plate element, and the bottom plate insulating element of said laminated unit, each of said at least four throughholes having a conductive lining, the electrodes layers of each of said at least two piezoelectric plate elements being partially extended to surround a respective one of said throughholes so that each electrode layer is electrically connected to the conductive lining of a respective throughhole.

41. An ink-jet printing head as set forth in claim 39, wherein said drive pulse applying means further includes a wiring sheet having at least four terminal pads, said laminated unit, including at least four throughholes being fixed to said wiring sheet so that the conductive lining of each of said at least four throughholes is electrically connected to a respective one of said terminal pads.

42. An ink-jet printing head for a serial ink-jet printer comprising:

a laminated unit integrally formed as a sintered ceramic product, said laminated unit including a bottom insulating plate element, a top insulating plate element, and a lamination core between said bottom and top insulating plate element said lamination core including at least two pairs of piezoelectric plate elements and at least one intermediate insulating plate element, said at least two pairs of piezoelectric plate elements and said at least one intermediate insulating plate element being alternatively laminated, and having an potential piezoelectric effect, said laminated unit having elongated pressure chambers defined by respective ones of said at least two pairs of piezoelectric plate elements fillable with ink, each of said pressure chambers having a volume corresponding to a thickness of a corresponding one of the elements of said at least two pairs of piezoelectric elements, each of said at least two pairs of piezoelectric plate elements having outer electrode layers formed on opposite outer surfaces and an intermediate electrode layer formed on an opposing surface of one of each of said at least two pairs of piezoelectric elements, each said outer electrode layers and said intermediate electrode layer of each pair of said at least two pairs of piezoelectric plate elements surrounding a corresponding one of said elongated pressure chambers, to thereby enable simultaneous polarization of all of said at least two pairs of piezoelectric plate elements, said laminated unit having an orifice in communication with each said pressure chamber of said at least two pairs of pressure chambers; and means for applying a drive pulse voltage to each pair of said at least two pairs of piezoelectric plate elements through the outer electrode layers and the intermediate electrode layer for reducing the thickness thereof upon application of said drive pulse voltage, resulting in a decrease in the volume of a corresponding pressure chamber to eject an ink-jet drop from a corresponding orifice.

43. An ink-jet printing head as set forth in claim 42, wherein said laminated unit includes said orifice.

44. An ink-jet printing head as set forth in claim 42, wherein said sintered ceramic product includes an orifice plate element, having orifices formed therein, attached to said laminated unit.

45. An ink-jet printing head as set forth in claim 42, wherein said laminated unit includes an ink reservoir in communication with said pressure chambers to supply ink to said pressure chambers.

46. An ink-jet printing head as set forth in claim 42, wherein said sintered product includes an ink reservoir block having an ink reservoir, said ink reservoir block being attached to said laminated unit with said ink reservoir in communication with said pressure chambers to supply ink to said pressure chamber.

47. An ink-jet printing head as set forth in claim 42, wherein said drive pulse applying means includes at least four throughholes extending through the at least two pairs of piezoelectric plate elements, the at least one intermediate insulating plate element, and the bottom plate insulating element of said laminated unit, each of said at least four throughholes having a conductive lining, the electrode layers of said at least two pairs of piezoelectric plate elements being partially extended to surround respective throughholes, so that each of said electrode layers is electrically connected to the conductive lining of a corresponding one of said throughholes.

48. An ink-jet printing head as set forth in claim 47, wherein said drive pulse applying means further includes a wiring sheet having at least four terminal pads, said laminated unit being fixed to said wiring sheet so that the conductive lining of each of said throughholes is electrically connected to one of said terminal pads.

49. An ink-jet printing head for a line ink-jet printer comprising;

a laminated unit integrally formed as a sintered ceramic product, said laminated unit including a bottom insulating plate element, a top insulating plate element and at least two piezoelectric plate elements between said bottom and top insulating plate element, each of said at least two piezoelectric plate elements defining a plurality of pressure chambers in said laminated unit fillable with ink, the plurality of pressure chambers of each of said at least two piezoelectric plate elements being laterally spaced and having a longitudinal axis parallel with each other, each of said at least two piezoelectric plate elements having electrode layers formed on surface areas thereof surrounding respective ones of said plurality of pressure chambers, each of said plurality of pressure chambers having a volume corresponding to a thickness of a respective one of said at least two piezoelectric plate elements surrounding a respective pressure chamber, said laminated unit having an orifice in communication with each one of said plurality of pressure chambers; and means for applying a drive pulse voltage to the electrode layers surrounding each of the plurality of pressure chambers of each of said at least two piezoelectric plate elements for reducing the thickness of the respective one of said at least two piezoelectric plate elements locally upon applying said drive pulse voltage resulting in a decrease in the volume of the respective pressure chamber to eject an ink-jet drop from a corresponding orifice.

50. An ink-jet printing head as set forth in claim 49, wherein said laminated unit includes said orifice.

51. An ink-jet printing head as set forth in claim 49, wherein said sintered ceramic product includes an orifice plate element, having orifices formed therein, attached to said laminated unit.

52. An ink-jet printing head as set forth in claim 49, wherein said laminated unit includes an ink reservoir in communication with said pressure chambers to supply ink to said pressure chambers.

53. An ink-jet printing head as set forth in claim 49, wherein said sintered ceramic product includes an ink reservoir block having an ink reservoir, said ink reservoir block being attached to said laminated unit with said ink reservoir in communication with said pressure chambers to supply ink to said pressure chambers.

54. An ink-jet printing head as set forth in claim 49, wherein said drive pulse applying means includes a plurality of throughholes extending through the at least two piezoelectric plate elements, the intermediate insulating plate element, and the bottom plate insulating element of said laminated unit, each of said throughholes having a conductive lining, the electrode layers of said at least two piezoelectric plate elements being partially extended to surround a respective one of said throughholes, so that each of said electrode layers is electrically connected to the conductive lining of a corresponding throughhole.

55. An ink-jet printing head as set forth in claim 54, wherein said drive pulse applying means further includes a wiring sheet having a plurality of terminal pads, said laminated unit being fixed to said wiring sheet so that the conductive lining of each of said throughholes is electrically connected to one of said terminal pads.

* * * * *

UNITED STATES PATENT AND TRADEMARK OFFICE

CERTIFICATE OF CORRECTION

PATENT NO. : 5,289,209

DATED : February 22, 1994

INVENTOR(S) : Naomichi SUZUKI et al.

It is certified that error appears in the above-indentified patent and that said Letters Patent is hereby corrected as shown below:

Claim 8, column 20, line 67, change "tow" to --two--.

Claim 22, column 23, line 8, change "tow" to --two--.

Claim 29, column 23, line 61, change "comprising;" to --comprising:--.

Claim 34, column 24, line 45, change "lest" to --least--.

Claim 35, column 24, line 53, change "sad" to --said--.

Claim 36, column 24, line 63, change "an" to --and--.

Claim 49, column 27, line 51, change "comprising;" to --comprising:--.

Signed and Sealed this

Twentieth Day of December, 1994

*Attest:*

Bruce Lehman

BRUCE LEHMAN

*Attesting Officer*

*Commissioner of Patents and Trademarks*